US007679627B2

(12) United States Patent
Sampsell et al.

(10) Patent No.: US 7,679,627 B2
(45) Date of Patent: Mar. 16, 2010

(54) CONTROLLER AND DRIVER FEATURES FOR BI-STABLE DISPLAY

(75) Inventors: Jeffrey B. Sampsell, San Jose, CA (US); Karen Tyger, Foster City, CA (US); Mithran Mathew, Mountain View, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 1184 days.

(21) Appl. No.: 11/097,819

(22) Filed: Apr. 1, 2005

(65) Prior Publication Data

US 2006/0077127 A1 Apr. 13, 2006

Related U.S. Application Data

(60) Provisional application No. 60/613,412, filed on Sep. 27, 2004.

(51) Int. Cl.
*G09G 5/10* (2006.01)

(52) U.S. Cl. ..... 345/690; 345/204; 348/430.1

(58) Field of Classification Search ..... 345/89, 345/690, 94, 204; 348/430.1
See application file for complete search history.

(56) References Cited

U.S. PATENT DOCUMENTS

| | | | |
|---|---|---|---|
| 3,982,239 | A | 9/1976 | Sherr |
| 4,403,248 | A | 9/1983 | te Velde |
| 4,441,791 | A | 4/1984 | Hornbeck |
| 4,459,182 | A | 7/1984 | te Velde |
| 4,482,213 | A | 11/1984 | Piliavin et al. |
| 4,500,171 | A | 2/1985 | Penz et al. |

(Continued)

FOREIGN PATENT DOCUMENTS

| | | | |
|---|---|---|---|
| EP | 0295802 | A | 12/1988 |

(Continued)

OTHER PUBLICATIONS

Seeger et al., "Stabilization of Electrostatically Actuated Mechanical Devices", (1997) International Conference on Solid State Sensors and Actuators; vol. 2, pp. 1133-1136.

(Continued)

*Primary Examiner*—Kevin M Nguyen
(74) *Attorney, Agent, or Firm*—Knobbe Martens Olson & Bear

(57) ABSTRACT

The invention comprises systems and methods for controller and driver features for displays, and in particular, controller and driver features that relate to displays with bi-stable display elements. In one embodiment, such a display includes at least one driving circuit and an array comprising a plurality of bi-stable display elements, where the array is configured to be driven by the driving circuit, and where the driving circuit is programmed to receive video data and provide a subset of the received video data to the array based on a frame skip count. In some embodiments, the frame skip count is programmable or dynamically determined. In another embodiment, a method of displaying data on an array having a plurality of bi-stable display elements comprises receiving video data comprising a plurality of frames, displaying selected frames based upon a frame skip count, measuring the change between each selected frame and a frame previous to the selected frame, and displaying non-selected frames if the measured change is greater than or equal to a threshold.

17 Claims, 10 Drawing Sheets

U.S. PATENT DOCUMENTS

| | | | |
|---|---|---|---|
| 4,519,676 | A | 5/1985 | te Velde |
| 4,566,935 | A | 1/1986 | Hornbeck |
| 4,571,603 | A | 2/1986 | Hornbeck et al. |
| 4,596,992 | A | 6/1986 | Hornbeck |
| 4,615,595 | A | 10/1986 | Hornbeck |
| 4,662,746 | A | 5/1987 | Hornbeck |
| 4,681,403 | A | 7/1987 | te Velde et al. |
| 4,709,995 | A | 12/1987 | Kuribayashi et al. |
| 4,710,732 | A | 12/1987 | Hornbeck |
| 4,856,863 | A | 8/1989 | Sampsell et al. |
| 4,859,060 | A | 8/1989 | Katagiri et al. |
| 4,954,789 | A | 9/1990 | Sampsell |
| 4,956,619 | A | 9/1990 | Hornbeck |
| 4,982,184 | A | 1/1991 | Kirkwood |
| 5,018,256 | A | 5/1991 | Hornbeck |
| 5,028,939 | A | 7/1991 | Hornbeck et al. |
| 5,034,736 | A | 7/1991 | Bennett et al. |
| 5,037,173 | A | 8/1991 | Sampsell et al. |
| 5,055,833 | A | 10/1991 | Hehlen et al. |
| 5,061,049 | A | 10/1991 | Hornbeck |
| 5,078,479 | A | 1/1992 | Vuilleumier |
| 5,079,544 | A | 1/1992 | DeMond et al. |
| 5,083,857 | A | 1/1992 | Hornbeck |
| 5,096,279 | A | 3/1992 | Hornbeck et al. |
| 5,099,353 | A | 3/1992 | Hornbeck |
| 5,124,834 | A | 6/1992 | Cusano et al. |
| 5,142,405 | A | 8/1992 | Hornbeck |
| 5,142,414 | A | 8/1992 | Koehler et al. |
| 5,162,787 | A | 11/1992 | Thompson et al. |
| 5,168,406 | A | 12/1992 | Nelson |
| 5,170,156 | A | 12/1992 | DeMond et al. |
| 5,172,262 | A | 12/1992 | Hornbeck |
| 5,179,274 | A | 1/1993 | Sampsell |
| 5,192,395 | A | 3/1993 | Boysel et al. |
| 5,192,946 | A | 3/1993 | Thompson et al. |
| 5,206,629 | A | 4/1993 | DeMond et al. |
| 5,212,582 | A | 5/1993 | Nelson |
| 5,214,419 | A | 5/1993 | DeMond et al. |
| 5,214,420 | A | 5/1993 | Thompson et al. |
| 5,216,537 | A | 6/1993 | Hornbeck |
| 5,226,099 | A | 7/1993 | Mignardi et al. |
| 5,227,900 | A | 7/1993 | Inaba et al. |
| 5,231,532 | A | 7/1993 | Magel et al. |
| 5,233,385 | A | 8/1993 | Sampsell |
| 5,233,456 | A | 8/1993 | Nelson |
| 5,233,459 | A | 8/1993 | Bozler et al. |
| 5,254,980 | A | 10/1993 | Hendrix et al. |
| 5,272,473 | A | 12/1993 | Thompson et al. |
| 5,278,652 | A | 1/1994 | Urbanus et al. |
| 5,280,277 | A | 1/1994 | Hornbeck |
| 5,287,096 | A | 2/1994 | Thompson et al. |
| 5,287,215 | A | 2/1994 | Warde et al. |
| 5,296,950 | A | 3/1994 | Lin et al. |
| 5,305,640 | A | 4/1994 | Boysel et al. |
| 5,312,513 | A | 5/1994 | Florence et al. |
| 5,323,002 | A | 6/1994 | Sampsell et al. |
| 5,325,116 | A | 6/1994 | Sampsell |
| 5,327,286 | A | 7/1994 | Sampsell et al. |
| 5,331,454 | A | 7/1994 | Hornbeck |
| 5,339,116 | A | 8/1994 | Urbanus et al. |
| 5,365,283 | A | 11/1994 | Doherty et al. |
| 5,396,593 | A | 3/1995 | Mori et al. |
| 5,411,769 | A | 5/1995 | Hornbeck |
| 5,444,566 | A | 8/1995 | Gale et al. |
| 5,446,479 | A | 8/1995 | Thompson et al. |
| 5,448,314 | A | 9/1995 | Heimbuch et al. |
| 5,452,024 | A | 9/1995 | Sampsell |
| 5,454,906 | A | 10/1995 | Baker et al. |
| 5,457,493 | A | 10/1995 | Leddy et al. |
| 5,457,566 | A | 10/1995 | Sampsell et al. |
| 5,459,602 | A | 10/1995 | Sampsell |
| 5,461,411 | A | 10/1995 | Florence et al. |
| 5,483,260 | A | 1/1996 | Parks et al. |
| 5,488,505 | A | 1/1996 | Engle |
| 5,489,952 | A | 2/1996 | Gove et al. |
| 5,497,172 | A | 3/1996 | Doherty et al. |
| 5,497,197 | A | 3/1996 | Gove et al. |
| 5,499,062 | A | 3/1996 | Urbanus |
| 5,506,597 | A | 4/1996 | Thompson et al. |
| 5,515,076 | A | 5/1996 | Thompson et al. |
| 5,517,347 | A | 5/1996 | Sampsell |
| 5,523,803 | A | 6/1996 | Urbanus et al. |
| 5,526,051 | A | 6/1996 | Gove et al. |
| 5,526,172 | A | 6/1996 | Kanack |
| 5,526,688 | A | 6/1996 | Boysel et al. |
| 5,535,047 | A | 7/1996 | Hornbeck |
| 5,548,301 | A | 8/1996 | Kornher et al. |
| 5,551,293 | A | 9/1996 | Boysel et al. |
| 5,552,924 | A | 9/1996 | Tregilgas |
| 5,552,925 | A | 9/1996 | Worley |
| 5,563,398 | A | 10/1996 | Sampsell |
| 5,567,334 | A | 10/1996 | Baker et al. |
| 5,570,135 | A | 10/1996 | Gove et al. |
| 5,578,976 | A | 11/1996 | Yao |
| 5,581,272 | A | 12/1996 | Conner et al. |
| 5,583,688 | A | 12/1996 | Hornbeck |
| 5,589,852 | A | 12/1996 | Thompson et al. |
| 5,597,736 | A | 1/1997 | Sampsell |
| 5,598,565 | A | 1/1997 | Reinhardt |
| 5,600,383 | A | 2/1997 | Hornbeck |
| 5,602,671 | A | 2/1997 | Hornbeck |
| 5,606,441 | A | 2/1997 | Florence et al. |
| 5,608,468 | A | 3/1997 | Gove et al. |
| 5,610,438 | A | 3/1997 | Wallace et al. |
| 5,610,624 | A | 3/1997 | Bhuva |
| 5,610,625 | A | 3/1997 | Sampsell |
| 5,612,713 | A | 3/1997 | Bhuva et al. |
| 5,619,061 | A | 4/1997 | Goldsmith et al. |
| 5,619,365 | A | 4/1997 | Rhoades et al. |
| 5,619,366 | A | 4/1997 | Rhoads et al. |
| 5,629,790 | A | 5/1997 | Neukermans et al. |
| 5,633,652 | A | 5/1997 | Kanbe et al. |
| 5,636,052 | A | 6/1997 | Arney et al. |
| 5,638,084 | A | 6/1997 | Kalt |
| 5,638,946 | A | 6/1997 | Zavracky |
| 5,646,768 | A | 7/1997 | Kaeiyama |
| 5,650,881 | A | 7/1997 | Hornbeck |
| 5,654,741 | A | 8/1997 | Sampsell et al. |
| 5,657,099 | A | 8/1997 | Doherty et al. |
| 5,659,374 | A | 8/1997 | Gale, Jr. et al. |
| 5,665,997 | A | 9/1997 | Weaver et al. |
| 5,745,193 | A | 4/1998 | Urbanus et al. |
| 5,745,281 | A | 4/1998 | Yi et al. |
| 5,754,160 | A | 5/1998 | Shimizu et al. |
| 5,771,116 | A | 6/1998 | Miller et al. |
| 5,784,189 | A | 7/1998 | Bozler et al. |
| 5,784,212 | A | 7/1998 | Hornbeck |
| 5,808,780 | A | 9/1998 | McDonald |
| 5,818,095 | A | 10/1998 | Sampsell |
| 5,835,255 | A | 11/1998 | Miles |
| 5,842,088 | A | 11/1998 | Thompson |
| 5,867,302 | A | 2/1999 | Fleming et al. |
| 5,912,758 | A | 6/1999 | Knipe et al. |
| 5,929,831 | A * | 7/1999 | Aratani et al. ..... 345/94 |
| 5,943,158 | A | 8/1999 | Ford et al. |
| 5,959,763 | A | 9/1999 | Bozler et al. |
| 5,966,235 | A | 10/1999 | Walker et al. |
| 5,986,796 | A | 11/1999 | Miles |
| 6,028,690 | A | 2/2000 | Carter et al. |
| 6,038,056 | A | 3/2000 | Florence et al. |
| 6,040,937 | A | 3/2000 | Miles |
| 6,049,317 | A | 4/2000 | Thompson et al. |
| 6,055,090 | A | 4/2000 | Miles |
| 6,061,075 | A | 5/2000 | Nelson et al. |

6,099,132 A 8/2000 Kaeriyama
6,100,872 A 8/2000 Aratani et al.
6,113,239 A 9/2000 Sampsell et al.
6,147,790 A 11/2000 Meier et al.
6,160,833 A 12/2000 Floyd et al.
6,180,428 B1 1/2001 Peeters et al.
6,201,633 B1 3/2001 Peeters et al.
6,232,936 B1 5/2001 Gove et al.
6,275,326 B1 8/2001 Bhalla et al.
6,282,010 B1 8/2001 Sulzbach et al.
6,295,154 B1 9/2001 Laor et al.
6,304,297 B1 10/2001 Swan
6,323,982 B1 11/2001 Hornbeck
6,327,071 B1 12/2001 Kimura
6,353,435 B2 * 3/2002 Kudo et al. ..... 345/204
6,356,085 B1 3/2002 Ryat et al.
6,356,254 B1 3/2002 Kimura
6,429,601 B1 8/2002 Friend et al.
6,433,917 B1 8/2002 Mei et al.
6,447,126 B1 9/2002 Hornbeck
6,465,355 B1 10/2002 Horsley
6,466,358 B2 10/2002 Tew
6,473,274 B1 10/2002 Maimone et al.
6,480,177 B2 11/2002 Doherty et al.
6,496,122 B2 12/2002 Sampsell
6,501,107 B1 12/2002 Sinclair et al.
6,507,330 B1 1/2003 Handschy et al.
6,507,331 B1 1/2003 Schlangen et al.
6,545,335 B1 4/2003 Chua et al.
6,548,908 B2 4/2003 Chua et al.
6,549,338 B1 4/2003 Wolverton et al.
6,552,840 B2 4/2003 Knipe
6,574,033 B1 6/2003 Chui et al.
6,589,625 B1 7/2003 Kothari et al.
6,593,934 B1 7/2003 Liaw et al.
6,600,201 B2 7/2003 Hartwell et al.
6,606,175 B1 8/2003 Sampsell et al.
6,625,047 B2 9/2003 Coleman, Jr.
6,630,786 B2 10/2003 Cummings et al.
6,632,698 B2 10/2003 Ives
6,643,069 B2 11/2003 Dewald
6,650,455 B2 11/2003 Miles
6,666,561 B1 12/2003 Blakley
6,674,090 B1 1/2004 Chua et al.
6,674,562 B1 1/2004 Miles
6,680,792 B2 1/2004 Miles
6,710,908 B2 3/2004 Miles et al.
6,741,377 B2 5/2004 Miles
6,741,384 B1 5/2004 Martin et al.
6,741,503 B1 5/2004 Farris et al.
6,747,785 B2 6/2004 Chen et al.
6,762,873 B1 7/2004 Coker et al.
6,775,174 B2 8/2004 Huffman et al.
6,778,155 B2 8/2004 Doherty et al.
6,781,643 B1 8/2004 Watanabe et al.
6,787,384 B2 9/2004 Okumura
6,787,438 B1 9/2004 Nelson
6,788,520 B1 9/2004 Behin et al.
6,794,119 B2 9/2004 Miles
6,811,267 B1 11/2004 Allen et al.
6,813,060 B1 11/2004 Garcia et al.
6,819,469 B1 11/2004 Koba
6,822,628 B2 11/2004 Dunphy et al.
6,825,835 B2 * 11/2004 Sano et al. ..... 345/204
6,829,132 B2 12/2004 Martin et al.
6,853,129 B1 2/2005 Cummings et al.
6,855,610 B2 2/2005 Tung et al.
6,859,218 B1 2/2005 Luman et al.
6,861,277 B1 3/2005 Monroe et al.
6,862,022 B2 3/2005 Slupe
6,862,029 B1 3/2005 D'Souza et al.
6,867,896 B2 3/2005 Miles
6,870,581 B2 3/2005 Li et al.
6,903,860 B2 6/2005 Ishii
7,071,930 B2 * 7/2006 Kondo et al. ..... 345/204
7,123,216 B1 10/2006 Miles
7,123,246 B2 * 10/2006 Nakatani et al. ..... 345/89
7,130,463 B1 * 10/2006 Spangler ..... 382/168
7,161,728 B2 1/2007 Sampsell et al.
2001/0003487 A1 6/2001 Miles
2001/0034075 A1 10/2001 Onoya
2001/0043171 A1 11/2001 Van Gorkom et al.
2001/0043205 A1 11/2001 Huang et al.
2001/0046081 A1 11/2001 Hayashi et al.
2001/0051014 A1 12/2001 Behin et al.
2002/0000959 A1 1/2002 Colgan et al.
2002/0005827 A1 1/2002 Kobayashi
2002/0012159 A1 1/2002 Tew
2002/0015104 A1 2/2002 Itoh et al.
2002/0015215 A1 2/2002 Miles
2002/0024711 A1 2/2002 Miles
2002/0036304 A1 3/2002 Ehmke et al.
2002/0050882 A1 5/2002 Hyman et al.
2002/0054424 A1 5/2002 Miles et al.
2002/0075226 A1 6/2002 Lippincott
2002/0075555 A1 6/2002 Miles
2002/0093722 A1 7/2002 Chan et al.
2002/0097133 A1 7/2002 Charvet et al.
2002/0126364 A1 9/2002 Miles
2002/0179421 A1 12/2002 Williams et al.
2002/0186108 A1 12/2002 Hallbjorner
2002/0190940 A1 12/2002 Itoh et al.
2003/0004272 A1 1/2003 Power
2003/0020699 A1 1/2003 Nakatani et al.
2003/0043157 A1 3/2003 Miles
2003/0072070 A1 4/2003 Miles
2003/0122773 A1 7/2003 Washio et al.
2003/0137215 A1 7/2003 Cabuz
2003/0137521 A1 7/2003 Zehner et al.
2003/0189536 A1 10/2003 Ruigt
2003/0202264 A1 10/2003 Weber et al.
2003/0202265 A1 10/2003 Reboa et al.
2003/0202266 A1 10/2003 Ring et al.
2004/0008396 A1 1/2004 Stappaerts
2004/0022044 A1 2/2004 Yasuoka et al.
2004/0027701 A1 2/2004 Ishikawa
2004/0051929 A1 3/2004 Sampsell et al.
2004/0058532 A1 3/2004 Miles et al.
2004/0080807 A1 4/2004 Chen et al.
2004/0145049 A1 7/2004 McKinnell et al.
2004/0147056 A1 7/2004 McKinnell et al.
2004/0160143 A1 8/2004 Shreeve et al.
2004/0174583 A1 9/2004 Chen et al.
2004/0179281 A1 9/2004 Reboa
2004/0212026 A1 10/2004 Van Brocklin et al.
2004/0217378 A1 11/2004 Martin et al.
2004/0217919 A1 11/2004 Pichl et al.
2004/0218251 A1 11/2004 Piehl et al.
2004/0218334 A1 11/2004 Martin et al.
2004/0218341 A1 11/2004 Martin et al.
2004/0223204 A1 11/2004 Mao et al.
2004/0227493 A1 11/2004 Van Brocklin et al.
2004/0240032 A1 12/2004 Miles
2004/0240138 A1 12/2004 Martin et al.
2004/0245588 A1 12/2004 Nikkel et al.
2004/0246242 A1 12/2004 Sasaki
2004/0263944 A1 12/2004 Miles et al.
2005/0001797 A1 1/2005 Miller et al.
2005/0001828 A1 1/2005 Martin et al.
2005/0012577 A1 1/2005 Pillans et al.
2005/0038950 A1 2/2005 Adelmann
2005/0057442 A1 3/2005 Way
2005/0068583 A1 3/2005 Gutkowski et al.
2005/0069209 A1 3/2005 Damera-Venkata et al.
2005/0116924 A1 6/2005 Sauvante et al.
2005/0206991 A1 9/2005 Chui et al.

| | | | |
|---|---|---|---|
| 2005/0286113 | A1 | 12/2005 | Miles |
| 2005/0286114 | A1 | 12/2005 | Miles |
| 2006/0017684 | A1 | 1/2006 | Fish |
| 2006/0044246 | A1 | 3/2006 | Mignard |
| 2006/0044298 | A1 | 3/2006 | Mignard et al. |
| 2006/0044928 | A1 | 3/2006 | Chui et al. |
| 2006/0056000 | A1 | 3/2006 | Mignard |
| 2006/0057754 | A1 | 3/2006 | Cummings |
| 2006/0066542 | A1 | 3/2006 | Chui |
| 2006/0066559 | A1 | 3/2006 | Chui et al. |
| 2006/0066560 | A1 | 3/2006 | Gally et al. |
| 2006/0066561 | A1 | 3/2006 | Chui et al. |
| 2006/0066594 | A1 | 3/2006 | Tyger |
| 2006/0066597 | A1 | 3/2006 | Sampsell |
| 2006/0066598 | A1 | 3/2006 | Floyd |
| 2006/0066601 | A1 | 3/2006 | Kothari |
| 2006/0066937 | A1 | 3/2006 | Chui |
| 2006/0066938 | A1 | 3/2006 | Chui |
| 2006/0067648 | A1 | 3/2006 | Chui et al. |
| 2006/0067653 | A1 | 3/2006 | Gally et al. |
| 2006/0077505 | A1 | 4/2006 | Chui et al. |
| 2006/0077520 | A1 | 4/2006 | Chui et al. |
| 2006/0103613 | A1 | 5/2006 | Chui |

FOREIGN PATENT DOCUMENTS

| | | | |
|---|---|---|---|
| EP | 0300754 | A2 | 1/1989 |
| EP | 0306308 | A2 | 3/1989 |
| EP | 0318050 | A | 5/1989 |
| EP | 0 417 523 | A | 3/1991 |
| EP | 0 467 048 | A | 1/1992 |
| EP | 0 583 102 | A1 | 7/1993 |
| EP | 0570906 | A | 11/1993 |
| EP | 0608056 | A1 | 7/1994 |
| EP | 0655725 | A1 | 5/1995 |
| EP | 0 667 548 | A1 | 8/1995 |
| EP | 0725380 | A1 | 8/1996 |
| EP | 0852371 | A1 | 7/1998 |
| EP | 0911794 | A1 | 4/1999 |
| EP | 1 017 038 | A | 7/2000 |
| EP | 1 146 533 | A | 10/2001 |
| EP | 1 158 481 | | 11/2001 |
| EP | 1 239 448 | | 9/2002 |
| EP | 1 280 129 | | 1/2003 |
| EP | 1343190 | A | 9/2003 |
| EP | 1345197 | A | 9/2003 |
| EP | 1381023 | A | 1/2004 |
| EP | 1473691 | A2 | 11/2004 |
| GB | 2401200 | A | 11/2004 |
| JP | 06-051721 | | 2/1994 |
| JP | 2001-331146 | | 11/2001 |
| JP | 2002-006818 | | 1/2002 |
| JP | 2002-287681 | | 10/2002 |
| JP | 2003-044011 | | 2/2003 |
| JP | 2004-29571 | | 1/2004 |
| JP | 2004-032207 | | 1/2004 |
| JP | 2004-088194 | | 3/2004 |
| JP | 2004-151222 | | 5/2004 |
| WO | WO 95/30924 | | 11/1995 |
| WO | WO 96/10889 | | 4/1996 |
| WO | WO 97/17628 | | 5/1997 |
| WO | WO 99/52006 | A3 | 10/1999 |
| WO | WO 01/73937 | A | 10/2001 |
| WO | WO 03/007049 | | 1/2003 |
| WO | WO 03/007049 | A1 | 1/2003 |
| WO | WO 03/015071 | A2 | 2/2003 |
| WO | WO 03/032288 | | 4/2003 |
| WO | WO 03/044765 | A2 | 5/2003 |
| WO | WO 03/060940 | A | 7/2003 |
| WO | WO 03/069413 | A1 | 8/2003 |
| WO | WO 03/073151 | A1 | 9/2003 |
| WO | WO 03/079323 | A | 9/2003 |
| WO | WO 03/090199 | A1 | 10/2003 |
| WO | WO 2004/006003 | A1 | 1/2004 |
| WO | WO 2004/026757 | A2 | 4/2004 |
| WO | WO 2004/049034 | A1 | 6/2004 |

OTHER PUBLICATIONS

Miles, MEMS-based interferometric modulator for display applications, Part of the SPIE Conference on Micromachined Devices and Components, vol. 3876, pp. 20-28 (1999).

Miles et al., 5.3: Digital Paper™: Reflective displays using interferometric modulation, SID Digest, vol. XXXI, 2000 pp. 32-35.

Official Communication in European App. No. 05255652.9 dated Aug. 27, 2007.

Peroulis et al., Low contact resistance series MEMS switches, 2002, pp. 223-226, vol. 1, IEEE MTT-S International Microwave Symposium Digest, New York, NY.

Bains, "Digital Paper Display Technology holds Promise for Portables", CommsDesign EE Times (2000).

Lieberman, "MEMS Display Looks to give PDAs Sharper Image" EE Times (2004).

Lieberman, "Microbridges at heart of new MEMS displays" EE Times (2004).

Office Action in Chinese App. No. 200510103558.3, received Jul. 4, 2008.

Extended European Search Report in App. No. 05255652.9 dated Jul. 2, 2008.

Office Action issued by the Japanese Patent Office on Apr. 3, 2009 in Japanese Patent Application No. 2005-226084.

Office Action in Chinese App. No. 200510103558.3, received Feb. 20, 2009.

Official Communication in App. No. 05255652.9 dated Sep. 28, 2009.

* cited by examiner

| | | Column Output Signals | |
|---|---|---|---|
| | | $+V_{bias}$ | $-V_{bias}$ |
| Row Output Signals | $-\Delta V$ | Actuate | Release |
| | 0 | Stable | Stable |
| | $+\Delta V$ | Release | Actuate |

CONTROLLER AND DRIVER FEATURES FOR BI-STABLE DISPLAY

CROSS REFERENCE TO RELATED APPLICATIONS

This application claims priority to U.S. Provisional Application No. 60/613,412, titled "Controller And Driver Features For Bi-Stable Display," filed Sep. 27, 2004, which is incorporated by reference, in its entirety. This application is related to U.S. application Ser. No. 11/096,546 titled "System Having Different Update Rates For Different Portions Of A Partitioned Display," filed concurrently, U.S. application Ser. No. 11/096,547 titled "Method And System For Driving A Bi-stable Display," filed concurrently, U.S. application Ser. No. 11/097,509 titled "System With Server Based Control Of Client Device Display Features," filed concurrently, U.S. application Ser. No. 11/097,820 titled "System and Method of Transmitting Video Data", filed concurrently, and U.S. application Ser. No. 11/097,818 titled "System and Method of Transmitting Video Data," filed concurrently, all of which are incorporated herein by reference and assigned to the assignee of the present invention.

BACKGROUND

1. Field of the Invention

The field of the invention relates to microelectromechanical systems (MEMS).

2. Description of the Related Technology

Microelectromechanical systems (MEMS) include micro mechanical elements, actuators, and electronics. Micromechanical elements may be created using deposition, etching, and or other micromachining processes that etch away parts of substrates and/or deposited material layers or that add layers to form electrical and electromechanical devices. One type of MEMS device is called an interferometric modulator. An interferometric modulator may comprise a pair of conductive plates, one or both of which may be transparent and/or reflective in whole or part and capable of relative motion upon application of an appropriate electrical signal. One plate may comprise a stationary layer deposited on a substrate, the other plate may comprise a metallic membrane separated from the stationary layer by an air gap. Such devices have a wide range of applications, and it would be beneficial in the art to utilize and/or modify the characteristics of these types of devices so that their features can be exploited in improving existing products and creating new products that have not yet been developed.

SUMMARY OF CERTAIN EMBODIMENTS

The system, method, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of Certain Embodiments" one will understand how the features of this invention provide advantages over other display devices.

A first embodiment includes a display, including at least one driving circuit, and an array including a plurality of bi-stable display elements, the array being configured to be driven by the driving circuit. The driving circuit is configured to receive video data and provide at least a subset of the received video data to the array based on a frame skip count.

In one aspect, the frame skip count is programmable. In a second aspect, the frame skip count is dynamically determined. In a third aspect, the driving circuit is further configured to provide a subset of the video data to the array based on changes that occur in one or more portions of the video data during a time period. In a fourth aspect, the driving circuit is further configured to evaluate the changes in the video data on a pixel-by-pixel basis. In a fifth aspect, the driving circuit is further configured to provide the video data based on a one or more display modes. In sixth aspect, the display further includes a user input device, and determination of the frame skip count includes a selection using the user input device.

A second embodiment includes a method of displaying data on an array having a plurality of bi-stable display elements, the method including receiving video data including a plurality of frames, and displaying the received frames using a frame skip count. In one aspect, the method further includes determining a measure of the change in video content between a selected frame of the plurality of frames and one or more frames received previous to the selected frame, and changing the frame skip count based on comparing the measure to a threshold value. In a second aspect, changing the frame skip count includes increasing the frame skip count if the change in video content between the selected frame and one or more previous frames is small, and decreasing the frame skip count if the change in video content between the selected frame and the one or more previous frames is large. In a third aspect, determining a measure of the change in video content includes calculating a histogram using one or more frames previous to the selected frame, and determining the measure based on the histogram.

A third embodiment includes a system for displaying data on an array having a plurality of bi-stable display elements, the system including means for receiving video data including a plurality of frames, and means for displaying frames using a frame skip count. In one aspect of the third embodiment, the system further includes means for determining a measure of the change in video content between a selected frame of the plurality of frames and one or more frames received previous to the selected frame, and means for changing the frame skip count based on comparing the measure to a threshold value. In a second embodiment, the means for changing the frame skip count includes means for increasing the frame skip count if the change in video content between the selected frame and one or more previous frames is small, and means for decreasing the frame skip count if the change in video content between the selected frame and the one or more previous frames is large. In a third embodiment, determining the measure of the change in video content includes means for calculating a histogram using one or more frames previous to the selected frame, and means for determining the measure of based on the histogram.

A fourth embodiment includes a system that includes a client having a bi-stable display, and a server configured to provide frame skip count information to the client, the frame skip count information being used by the client to determine a video refresh rate for the bi-stable display of the client. In one aspect, the server provides video data to the client based on the frame skip count information. In a second aspect, the frame skip count information is used to implement a video refresh rate for a particular region of the bi-stable display. In a third aspect, the location of the region is defined by the server. In a fourth aspect, the size of the region is defined by the server.

A fifth embodiment includes a serer configured to provide frame skip count information to a client, the frame skip count being used by the client to implement a video refresh rate for a bi-stable display of the client. In one aspect of the fifth embodiment, the frame skip count is used to implement a video refresh rate for one or more regions of the bi-stable display. In a second aspect, location of the one or more regions are defined by the server. In a third aspect, size of the one or more regions are defined by the server.

A sixth embodiment includes a client device having a bi-stable display, the client device configured to provide frame skip count information, and a server configured to receive frame skip count information from the client, and to provide video data to the client based on the frame skip count information. In a first aspect of the sixth embodiment, the frame skip count information is used to implement a video refresh rate for one or more regions of the bi-stable display. In a second aspect, the location of the one or more regions are defined by the server. In a third aspect, the size of the one or more regions are defined by the server. In a fourth aspect, the client device includes an input device, and wherein the frame skip count information provided by the client device is based on a selection made using the input device.

DETAILED DESCRIPTION OF CERTAIN EMBODIMENTS

Figure 1:
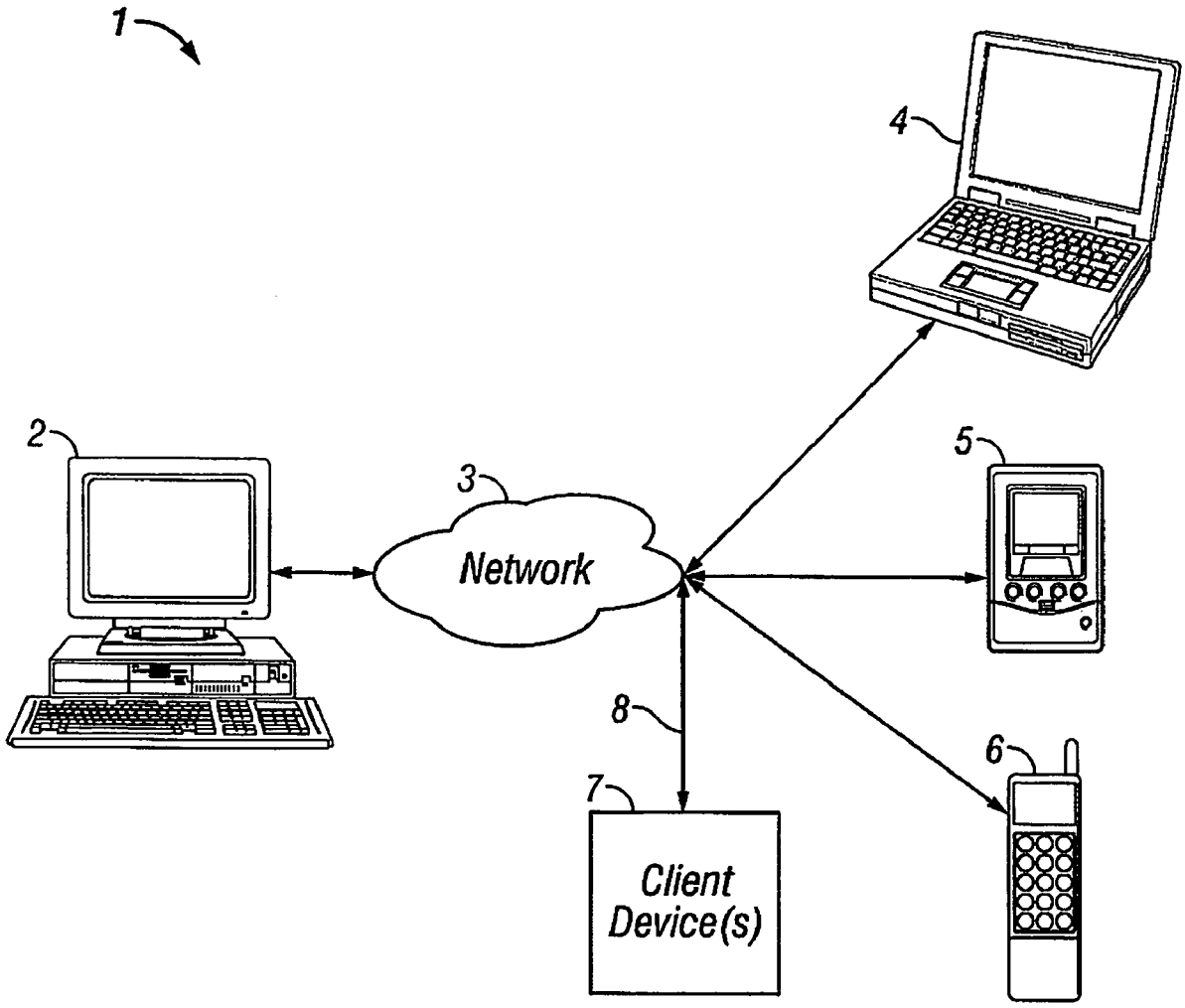
FIG. 1 illustrates a networked system of one embodiment.

The following detailed description is directed to certain specific embodiments. However, the invention can be embodied in a multitude of different ways. Reference in this specification to "one embodiment" or "an embodiment" means that a particular feature, structure, or characteristic described in connection with the embodiment is included in at least one embodiment. The appearances of the phrase "in one embodiment," "according to one embodiment," or "in some embodiments" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

In one embodiment, a display array on a device includes at least one driving circuit and an array of means, e.g., interferometric modulators, on which video data is displayed. Video data, as used herein, refers to any kind of displayable data, including pictures, graphics, and words, displayable in either static or dynamic images (for example, a series of video frames that when viewed give the appearance of movement, e.g., a continuous ever-changing display of stock quotes, a "video clip", or data indicating the occurrence of an event of action). Video data, as used herein, also refers to any kind of control data, including instructions on how the video data is to be processed (display mode), such as frame rate, and data format. The array is driven by the driving circuit to display video data.

In one embodiment the driving circuit can be programmed to receive video data and provide a subset of the received video data to the display array for display, where the subset provided is based on a particular refresh rate. For example, if the video data displayed changes relatively infrequently, not every frame of video data needs to be displayed to adequately convey the information in the video data. In some embodiments, every other frame can be displayed so that, for example, the display array, or a portion of the display array, is updated twice a second instead of four times per second. A "frame skip count" specifies a number of frames not to be displayed. The frame skip count can be programmed into the device, or it can be determined dynamically based on, for example, changes that occur in one or more portions of the video data during a time period. In another embodiment, a method provides video data to an array having numerous interferometric modulators, where the video data is provided to different portions of the display array and each portion of the display array can be updated with its own refresh rate. One embodiment of this method includes receiving video data, determining a refresh rate for each of the one or more portions of an array of interferometric modulators based on one or more characteristics of the video data, and displaying the video data on the one or more portions of the array using the corresponding determined refresh rate. By updating the display array at a selected slower refresh rate, or at a refresh rate as needed to adequately convey the video data and no faster, fewer screen refreshes are required, which results in lower power consumption. Also, depending on the configuration of the device, this can also result in less data being transferred to the device, for example, in a wireless telephone system, which saves bandwidth and increases system utilization.

In this description, reference is made to the drawings wherein like parts are designated with like numerals throughout. The invention may be implemented in any device that is configured to display an image, whether in motion (e.g., video) or stationary (e.g., still image), and whether textual or pictorial. More particularly, it is contemplated that the invention may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

Spatial light modulators used for imaging applications come in many different forms. Transmissive liquid crystal display (LCD) modulators modulate light by controlling the twist and/or alignment of crystalline materials to block or pass light. Reflective spatial light modulators exploit various physical effects to control the amount of light reflected to the imaging surface. Examples of such reflective modulators include reflective LCDs, and digital micromirror devices.

Another example of a spatial light modulator is an interferometric modulator that modulates light by interference. Interferometric modulators are bi-stable display elements which employ a resonant optical cavity having at least one movable or deflectable wall. Constructive interference in the optical cavity determines the color of the viewable light emerging from the cavity. As the movable wall, typically comprised at least partially of metal, moves towards the stationary front surface of the cavity, the interference of light within the cavity is modulated, and that modulation affects the color of light emerging at the front surface of the modulator. The front surface is typically the surface where the image seen by the viewer appears, in the case where the interferometric modulator is a direct-view device.

FIG. 1 illustrates a networked system in accordance with one embodiment. A server 2, such as a Web server is operatively coupled to a network 3. The server 2 can correspond to a Web server, to a cell-phone server, to a wireless e-mail server, and the like. The network 3 can include wired networks, or wireless networks, such as WiFi networks, cell-phone networks, Bluetooth networks, and the like.

The network 3 can be operatively coupled to a broad variety of devices. Examples of devices that can be coupled to the network 3 include a computer such as a laptop computer 4, a personal digital assistant (PDA) 5, which can include wireless handheld devices such as the BlackBerry, a Palm Pilot, a Pocket PC, and the like, and a cell phone 6, such as a Web-enabled cell phone, Smartphone, and the like. Many other devices can be used, such as desk-top PCs, set-top boxes, digital media players, handheld PCs, Global Positioning System (GPS) navigation devices, automotive displays, or other stationary and mobile displays. For convenience of discussion all of these devices are collectively referred to herein as the client device 7.

Figure 2:
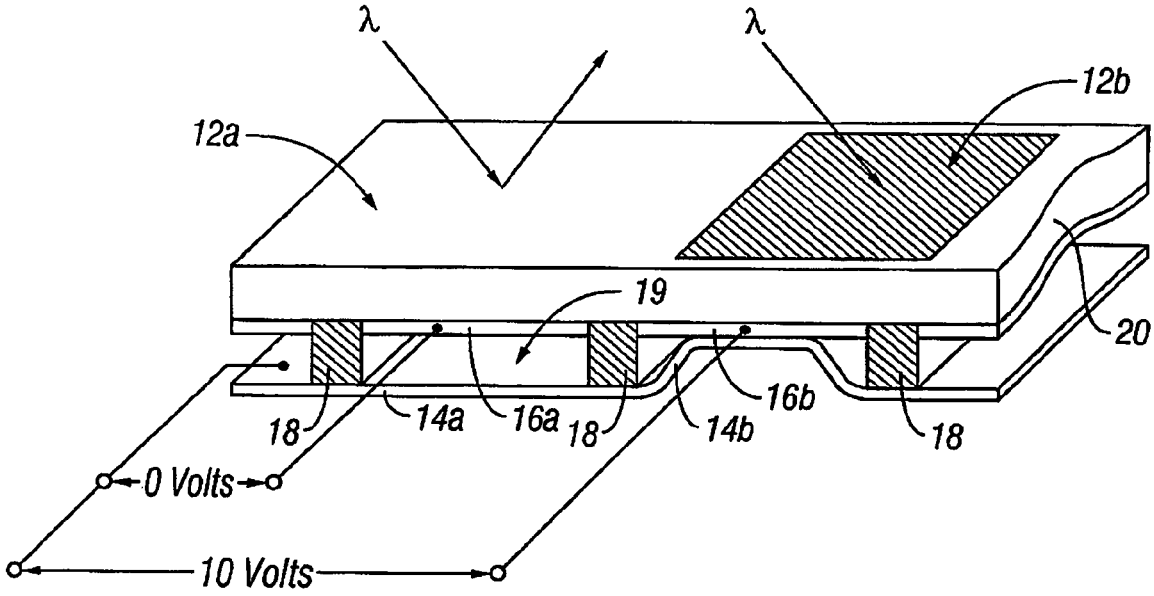
FIG. 2 is an isometric view depicting a portion of one embodiment of an interferometric modulator display array in which a movable reflective layer of a first interferometric modulator is in a released position and a movable reflective layer of a second interferometric modulator is in an actuated position.

One bi-stable display element embodiment comprising an interferometric MEMS display element is illustrated in FIG. 2. In these devices, the pixels are in either a bright or dark state. In the bright ("on" or "open") state, the display element reflects a large portion of incident visible light to a user. When in the dark ("off" or "closed") state, the display element reflects little incident visible light to the user. Depending on the embodiment, the light reflectance properties of the "on" and "off" states may be reversed. MEMS pixels can be configured to reflect predominantly at selected colors, allowing for a color display in addition to black and white.

FIG. 2 is an isometric view depicting two adjacent pixels in a series of pixels of a visual display array, wherein each pixel comprises a MEMS interferometric modulator. In some embodiments, an interferometric modulator display array comprises a row/column array of these interferometric modulators. Each interferometric modulator includes a pair of reflective layers positioned at a variable and controllable distance from each other to form a resonant optical cavity with at least one variable dimension. In one embodiment, one of the reflective layers may be moved between two positions. In the first position, referred to herein as the released state, the movable layer is positioned at a relatively large distance from a fixed partially reflective layer. In the second position, the movable layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 2 includes two adjacent interferometric modulators 12*a* and 12*b*. In the interferometric modulator 12*a* on the left, a movable and highly reflective layer 14*a* is illustrated in a released position at a predetermined distance from a fixed partially reflective layer 16*a*. In the interferometric modulator 12*b* on the right, the movable highly reflective layer 14*b* is illustrated in an actuated position adjacent to the fixed partially reflective layer 16*b*.

The partially reflective layers 16*a*, 16*b* are electrically conductive, partially transparent and fixed, and may be fabricated, for example, by depositing one or more layers each of chromium and indium-tin-oxide onto a transparent substrate 20. The layers are patterned into parallel strips, and may form row electrodes in a display device as described further below. The highly reflective layers 14*a*, 14*b* may be formed as a series of parallel strips of a deposited metal layer or layers (orthogonal to the row electrodes, partially reflective layers 16*a*, 16*b*) deposited on top of supports 18 and an intervening sacrificial material deposited between the supports 18. When the sacrificial material is etched away, the deformable metal layers are separated from the fixed metal layers by a defined air gap 19. A highly conductive and reflective material such as aluminum may be used for the deformable layers, and these strips may form column electrodes in a display device.

With no applied voltage, the air gap 19 remains between the layers 14*a*, 16*a* and the deformable layer is in a mechanically relaxed state as illustrated by the interferometric modulator 12*a* in FIG. 2. However, when a potential difference is applied to a selected row and column, the capacitor formed at the intersection of the row and column electrodes at the corresponding pixel becomes charged, and electrostatic forces pull the electrodes together. If the voltage is high enough, the movable layer is deformed and is forced against the fixed layer (a dielectric material which is not illustrated in this Figure may be deposited on the fixed layer to prevent shorting and control the separation distance) as illustrated by the interferometric modulator 12*b* on the right in FIG. 2. The behavior is the same regardless of the polarity of the applied potential difference. In this way, row/column actuation that can control the reflective vs. non-reflective interferometric modulator states is analogous in many ways to that used in conventional LCD and other display technologies.

FIGS. 3 through 5 illustrate an exemplary process and system for using an array of interferometric modulators in a display application. However, the process and system can also be applied to other displays, e.g., plasma, EL, OLED, STN LCD, and TFT LCD.

Currently, available flat panel display controllers and drivers have been designed to work almost exclusively with displays that need to be constantly refreshed. Thus, the image displayed on plasma, EL, OLED, STN LCD, and TFT LCD panels, for example, will disappear in a fraction of a second if not refreshed many times within a second. However, because interferometric modulators of the type described above have the ability to hold their state for a longer period of time without refresh, wherein the state of the interferometric modulators may be maintained in either of two states without refreshing, a display that uses interferometric modulators may be referred to as a bi-stable display. In one embodiment, the state of the pixel elements is maintained by applying a bias voltage, sometimes referred to as a latch voltage, to the one or more interferometric modulators that comprise the pixel element.

In general, a display device typically requires one or more controllers and driver circuits for proper control of the display device. Driver circuits, such as those used to drive LCD's, for example, may be bonded directly to, and situated along the edge of the display panel itself. Alternatively, driver circuits may be mounted on flexible circuit elements connecting the display panel (at its edge) to the rest of an electronic system. In either case, the drivers are typically located at the interface of the display panel and the remainder of the electronic system.

Figure 3A:
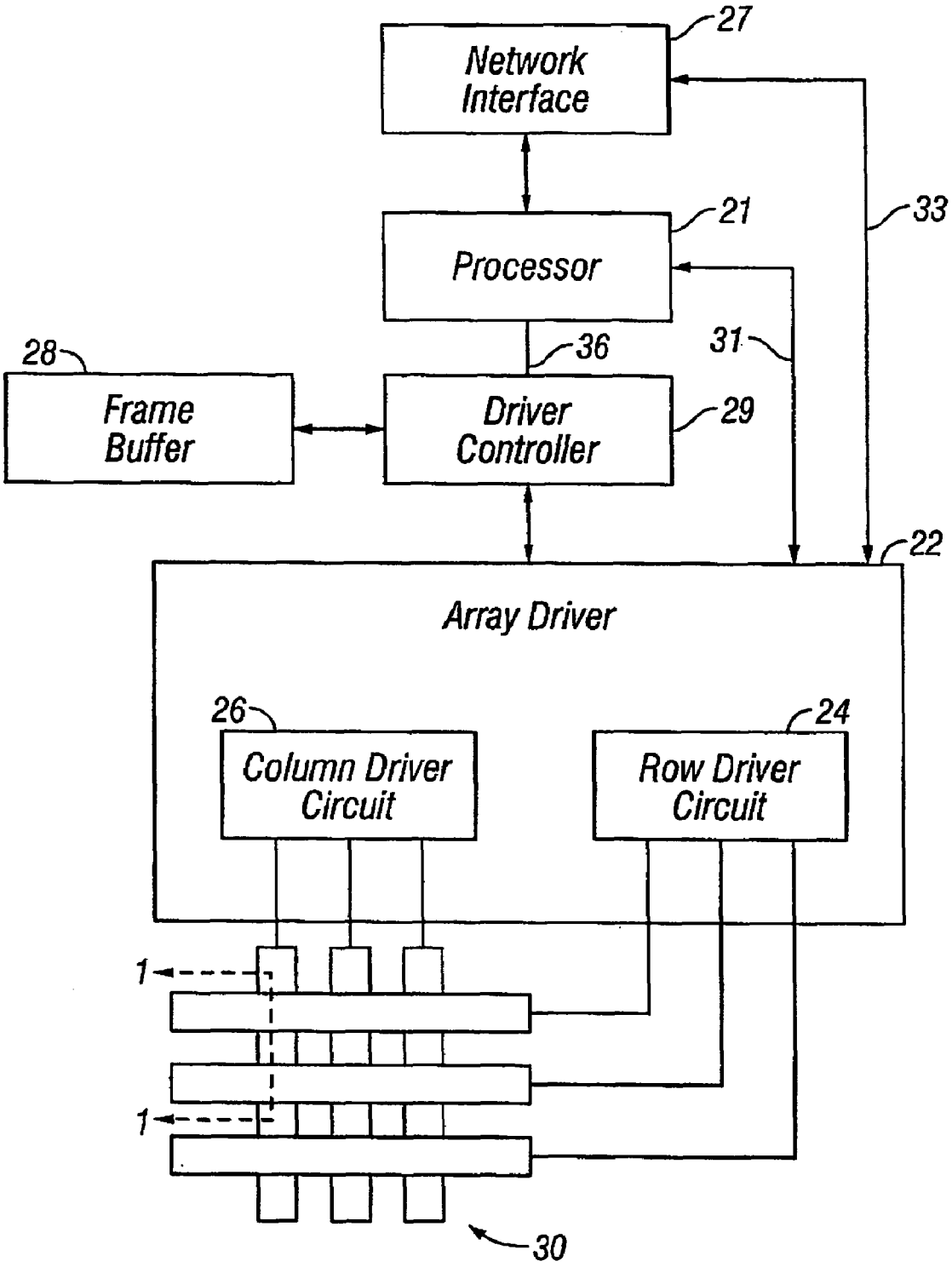
FIG. 3A is a system block diagram illustrating one embodiment of an electronic device incorporating a 3×3 interferometric modulator display array.

FIG. 3A is a system block diagram illustrating some embodiments of an electronic device that can incorporate various aspects. In the exemplary embodiment, the electronic device includes a processor 21 which may be any general purpose single- or multi-chip microprocessor such as an ARM, Pentium®, Pentium II®, Pentium III®, Pentium IV®, Pentium® Pro, an 8051, a MIPS®, a Power PC®, an ALPHA®, or any special purpose microprocessor such as a digital signal processor, microcontroller, or a programmable gate array. As is conventional in the art, the processor 21 may be configured to execute one or more software modules. In addition to executing an operating system, the processor may be configured to execute one or more software applications, including a web browser, a telephone application, an email program, or any other software application.

FIG. 3A illustrates an embodiment of electronic device that includes a network interface 27 connected to a processor 21 and, according to some embodiments, the network interface can be connected to an array driver 22. The network interface 27 includes the appropriate hardware and software so that the device can interact with another device over a network, for example, the server 2 shown in FIG. 1. The processor 21 is connected to driver controller 29 which is connected to an array driver 22 and to frame buffer 28. In some embodiments, the processor 21 is also connected to the array driver 22. The array driver 22 is connected to and drives the display array 30. The components illustrated in FIG. 3A illustrate a configuration of an interferometric modulator display. However, this configuration can also be used in a LCD with an LCD controller and driver. As illustrated in FIG. 3A, the driver controller 29 is connected to the processor 21 via a parallel bus 36. Although a driver controller 29, such as a LCD controller, is often associated with the system processor 21, as a stand-alone Integrated Circuit (IC), such controllers may be implemented in many ways. They may be embedded in the processor 21 as hardware, embedded in the processor 21 as software, or fully integrated in hardware with the array driver 22. In one embodiment, the driver controller 29 takes the display information generated by the processor 21, reformats that information appropriately for high speed transmission to the display array 30, and sends the formatted information to the array driver 22.

The array driver 22 receives the formatted information from the driver controller 29 and reformats the video data into a parallel set of waveforms that are applied many times per second to the hundreds and sometimes thousands of leads coming from the display's x-y matrix of pixels. The currently available flat panel display controllers and drivers such as those described immediately above have been designed to work almost exclusively with displays that need to be constantly refreshed. Because bi-stable displays (e.g., an array of interferometric modulators) do not require such constant refreshing, features that decrease power requirements may be realized through the use of bi-stable displays. However, if bi-stable displays are operated by the controllers and drivers that are used with current displays the advantages of a bi-stable display may not be optimized. Thus, improved controller and driver systems and methods for use with bi-stable displays are desired. For high speed bi-stable displays, such as the interferometric modulators described above, these improved controllers and drivers preferably implement low-refresh-rate modes, video rate refresh modes, and unique modes to facilitate the unique capabilities of bi-stable modulators. According to the methods and systems described herein, a bi-stable display may be configured to reduce power requirements in various manners.

In one embodiment illustrated by FIG. 3A, the array driver 22 receives video data from the processor 21 via a data link 31 bypassing the driver controller 29. The data link 31 may comprise a serial peripheral interface ("SPI"), $I^2C$ bus, parallel bus, or any other available interface. In one embodiment shown in FIG. 3A, the processor 21 provides instructions to the array driver 22 that allow the array driver 22 to optimize the power requirements of the display array 30 (e.g., an interferometric modulator display). In one embodiment, video data intended for a portion of the display, such as for example defined by the server 2, can be identified by data packet header information and transmitted via the data link 31. In addition, the processor 21 can route primitives, such as graphical primitives, along data link 31 to the array driver 22. These graphical primitives can correspond to instructions such as primitives for drawing shapes and text.

Still referring to FIG. 3A, in one embodiment, video data may be provided from the network interface 27 to the array driver 22 via data link 33. In one embodiment, the network interface 27 analyzes control information that is transmitted from the server 2 and determines whether the incoming video should be routed to either the processor 21 or, alternatively, the array driver 22.

In one embodiment, video data provided by data link 33 is not stored in the frame buffer 28, as is usually the case in many embodiments. It will also be understood that in some embodiments, a second driver controller (not shown) can also be used to render video data for the array driver 22. The data link 33 may comprise a SPI, $I^2C$ bus, or any other available interface. The array driver 22 can also include address decoding, row and column drivers for the display and the like. The network interface 27 can also provide video data directly to the array driver 22 at least partially in response to instructions embedded within the video data provided to the network interface 27. It will be understood by the skilled practitioner that arbiter logic can be used to control access by the network interface 27 and the processor 21 to prevent data collisions at the array driver 22. In one embodiment, a driver executing on the processor 21 controls the timing of data transfer from the network interface 27 to the array driver 22 by permitting the data transfer during time intervals that are typically unused by the processor 21, such as time intervals traditionally used for vertical blanking delays and/or horizontal blanking delays.

Advantageously, this design permits the server 2 to bypass the processor 21 and the driver controller 29, and to directly address a portion of the display array 30. For example, in the illustrated embodiment, this permits the server 2 to directly address a predefined display array area of the display array 30. In one embodiment, the amount of data communicated between the network interface 27 and the array driver 22 is relatively low and is communicated using a serial bus, such as an Inter-Integrated Circuit ($I^2C$) bus or a Serial Peripheral Interface (SPI) bus. It will also be understood, however, that where other types of displays are utilized, that other circuits will typically also be used. The video data provided via data link 33 can advantageously be displayed without a frame buffer 28 and with little or no intervention from the processor 21.

FIG. 3A also illustrates a configuration of a processor 21 coupled to a driver controller 29, such as an interferometric modulator controller. The driver controller 29 is coupled to the array driver 22, which is connected to the display array 30. In this embodiment, the driver controller 29 accounts for the display array 30 optimizations and provides information to the array driver 22 without the need for a separate connection between the array driver 22 and the processor 21. In some embodiments, the processor 21 can be configured to communicate with a driver controller 29, which can include a frame buffer 28 for temporary storage of one or more frames of video data.

As shown in FIG. 3A, in one embodiment the array driver 22 includes a row driver circuit 24 and a column driver circuit 26 that provide signals to a pixel display array 30. The cross section of the array illustrated in FIG. 2 is shown by the lines 1-1 in FIG. 3A. For MEMS interferometric modulators, the row/column actuation protocol may take advantage of a hysteresis property of these devices illustrated in FIG. 4A. It may require, for example, a 10 volt potential difference to cause a movable layer to deform from the released state to the actuated state. However, when the voltage is reduced from that value, the movable layer maintains its state as the voltage drops back below 10 volts. In the exemplary embodiment of FIG. 4A, the movable layer does not release completely until the voltage drops below 2 volts. There is thus a range of voltage, about 3 to 7 V in the example illustrated in FIG. 4A, where there exists a window of applied voltage within which the device is stable in either the released or actuated state. This is referred to herein as the "hysteresis window" or "stability window."

Figures 4A, 4B:
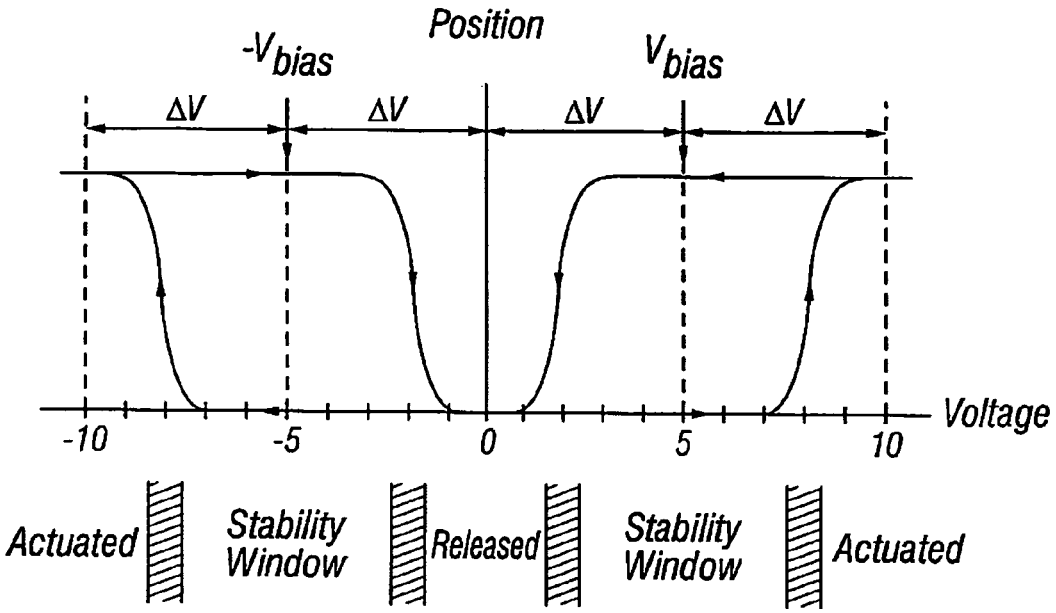
FIG. 4A is a diagram of movable mirror position versus applied voltage for one exemplary embodiment of an interferometric modulator of FIG. 2.
FIG. 4B is an illustration of a set of row and column voltages that may be used to drive an interferometric modulator display array.

For a display array having the hysteresis characteristics of FIG. 4A, the row/column actuation protocol can be designed such that during row strobing, pixels in the strobed row that are to be actuated are exposed to a voltage difference of about 10 volts, and pixels that are to be released are exposed to a voltage difference of close to zero volts. After the strobe, the pixels are exposed to a steady state voltage difference of about 5 volts such that they remain in whatever state the row strobe put them in. After being written, each pixel sees a potential difference within the "stability window" of 3-7 volts in this example. This feature makes the pixel design illustrated in FIG. 2 stable under the same applied voltage conditions in either an actuated or released pre-existing state. Since each pixel of the interferometric modulator, whether in the actuated or released state, is essentially a capacitor formed by the fixed and moving reflective layers, this stable state can be held at a voltage within the hysteresis window with almost no power dissipation. Essentially no current flows into the pixel if the applied potential is fixed.

In typical applications, a display frame may be created by asserting the set of column electrodes in accordance with the desired set of actuated pixels in the first row. A row pulse is then applied to the row 1 electrode, actuating the pixels corresponding to the asserted column lines. The asserted set of column electrodes is then changed to correspond to the desired set of actuated pixels in the second row. A pulse is then applied to the row 2 electrode, actuating the appropriate pixels in row 2 in accordance with the asserted column electrodes. The row 1 pixels are unaffected by the row 2 pulse, and remain in the state they were set to during the row 1 pulse. This may be repeated for the entire series of rows in a sequential fashion to produce the frame. Generally, the frames are refreshed and/or updated with new video data by continually repeating this process at some desired number of frames per second. A wide variety of protocols for driving row and column electrodes of pixel arrays to produce display array frames are also well known and may be used.

Figure 3B:
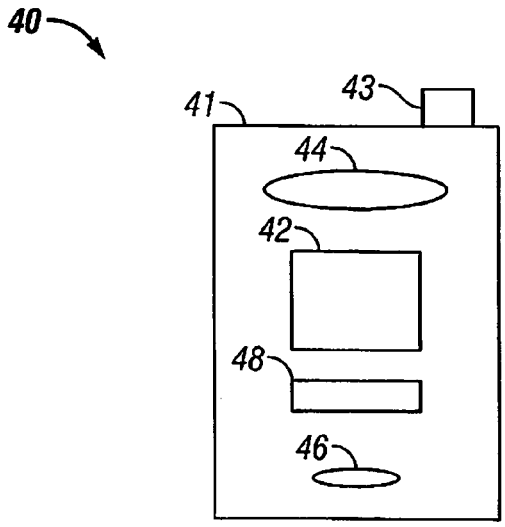
FIG. 3B is an illustration of an embodiment of a client of the server-based wireless network system of FIG. 1.

One embodiment of a client device 7 is illustrated in FIG. 3B. The exemplary client 40 includes a housing 41, a display 42, an antenna 43, a speaker 44, an input device 48, and a microphone 46. The housing 41 is generally formed from any of a variety of manufacturing processes as are well known to those of skill in the art, including injection molding, and vacuum forming. In addition, the housing 41 may be made from any of a variety of materials, including but not limited to plastic, metal, glass, rubber, and ceramic, or a combination thereof. In one embodiment the housing 41 includes removable portions (not shown) that may be interchanged with other removable portions of different color, or containing different logos, pictures, or symbols.

The display 42 of exemplary client 40 may be any of a variety of displays, including a bi-stable display, as described herein with respect to, for example, FIGS. 2, 3A, and 4-6. In other embodiments, the display 42 includes a flat-panel display, such as plasma, EL, OLED, STN LCD, or TFT LCD as described above, or a non-flat-panel display, such as a CRT or other tube device, as is well known to those of skill in the art. However, for purposes of describing the present embodiment, the display 42 includes an interferometric modulator display, as described herein.

Figure 3C:
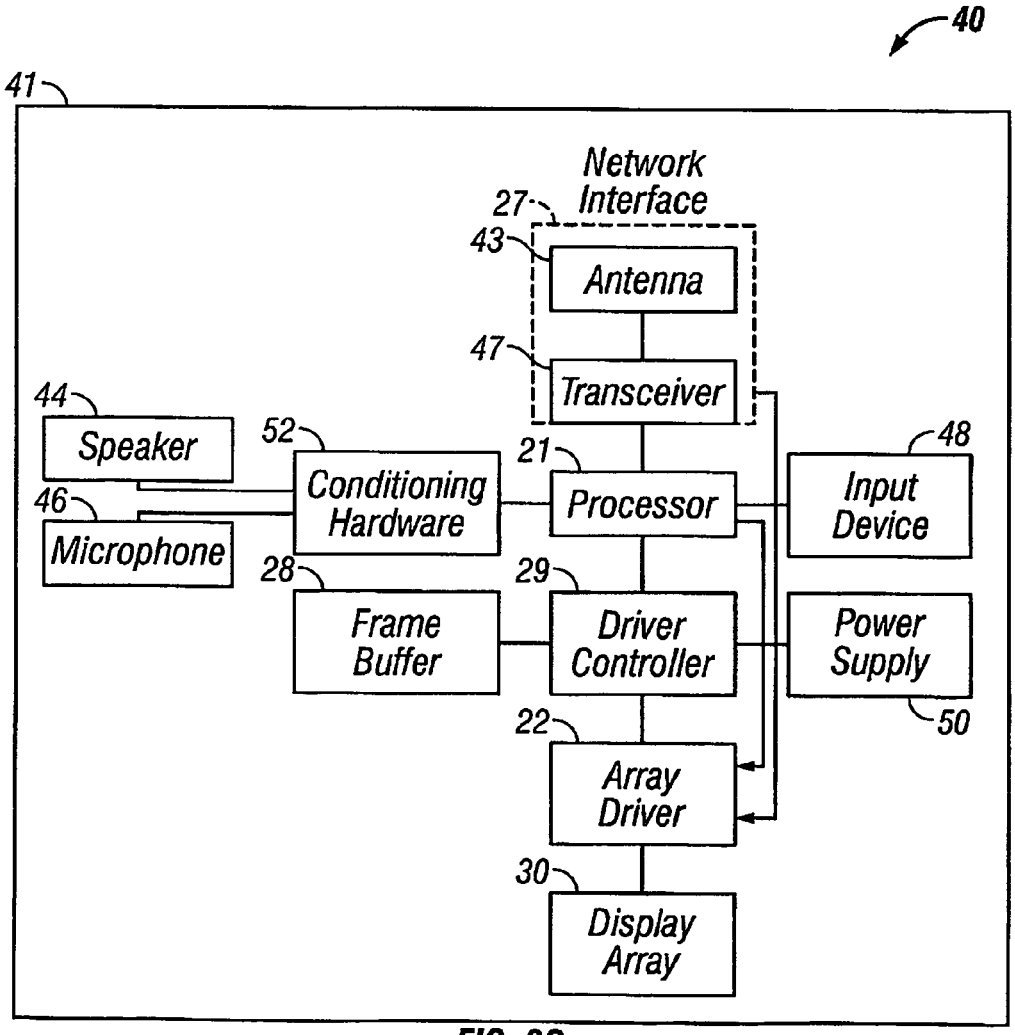
FIG. 3C is an exemplary block diagram configuration of the client in FIG. 3B.

The components of one embodiment of exemplary client 40 are schematically illustrated in FIG. 3C. The illustrated exemplary client 40 includes a housing 41 and can include additional components at least partially enclosed therein. For example, in one embodiment, the client exemplary 40 includes a network interface 27 that includes an antenna 43 which is coupled to a transceiver 47. The transceiver 47 is connected to a processor 21, which is connected to conditioning hardware 52. The conditioning hardware 52 is connected to a speaker 44 and a microphone 46. The processor 21 is also connected to an input device 48 and a driver controller 29. The driver controller 29 is coupled to a frame buffer 28, and to an array driver 22, which in turn is coupled to a display array 30. A power supply 50 provides power to all components as required by the particular exemplary client 40 design.

The network interface 27 includes the antenna 43, and the transceiver 47 so that the exemplary client 40 can communicate with another device over a network 3, for example, the server 2 shown in FIG. 1. In one embodiment the network interface 27 may also have some processing capabilities to relieve requirements of the processor 21. The antenna 43 is any antenna known to those of skill in the art for transmitting and receiving signals. In one embodiment, the antenna transmits and receives RF signals according to the IEEE 802.11 standard, including IEEE 802.11(a), (b), or (g). In another embodiment, the antenna transmits and receives RF signals according to the BLUETOOTH standard. In the case of a cellular telephone, the antenna is designed to receive CDMA, GSM, AMPS or other known signals that are used to communicate within a wireless cell phone network. The transceiver 47 pre-processes the signals received from the antenna 43 so that they may be received by and further processed by the processor 21. The transceiver 47 also processes signals received from the processor 21 so that they may be transmitted from the exemplary client 40 via the antenna 43.

Processor 21 generally controls the overall operation of the exemplary client 40, although operational control may be shared with or given to the server 2 (not shown), as will be described in greater detail below. In one embodiment, the processor 21 includes a microcontroller, CPU, or logic unit to control operation of the exemplary client 40. Conditioning hardware 52 generally includes amplifiers and filters for transmitting signals to the speaker 44, and for receiving signals from the microphone 46. Conditioning hardware 52 may be discrete components within the exemplary client 40, or may be incorporated within the processor 21 or other components.

The input device 48 allows a user to control the operation of the exemplary client 40. In one embodiment, input device 48 includes a keypad, such as a QWERTY keyboard or a telephone keypad, a button, a switch, a touch-sensitive screen, a pressure- or heat-sensitive membrane. In one embodiment, a microphone is an input device for the exemplary client 40. When a microphone is used to input data to the device, voice commands may be provided by a user for controlling operations of the exemplary client 40.

In one embodiment, the driver controller 29, array driver 22, and display array 30 are appropriate for any of the types of displays described herein. For example, in one embodiment, driver controller 29 is a conventional display controller or a bi-stable display controller (e.g., an interferometric modulator controller). In another embodiment, array driver 22 is a conventional driver or a bi-stable display driver (e.g., a interferometric modulator display). In yet another embodiment, display array 30 is a typical display array or a bi-stable display array (e.g., a display including an array of interferometric modulators).

Power supply 50 is any of a variety of energy storage devices as are well known in the art. For example, in one embodiment, power supply 50 is a rechargeable battery, such as a nickel-cadmium battery or a lithium ion battery. In another embodiment, power supply 50 is a renewable energy source, a capacitor, or a solar cell, including a plastic solar cell, and solar-cell paint. In another embodiment, power supply 50 is configured to receive power from a wall outlet.

In one embodiment, the array driver 22 contains a register that may be set to a predefined value to indicate that the input video stream is in an interlaced format and should be displayed on the bi-stable display in an interlaced format, without converting the video stream to a progressive scanned format. In this way the bi-stable display does not require interlace-to-progressive scan conversion of interlace video data.

In some implementations control programmability resides, as described above, in a display controller which can be located in several places in the electronic display system. In some cases control programmability resides in the array driver 22 located at the interface between the electronic display system and the display component itself. Those of skill in the art will recognize that the above-described optimization may be implemented in any number of hardware and/or software components and in various configurations.

In one embodiment, circuitry is embedded in the array driver 22 to take advantage of the fact that the output signal set of most graphics controllers includes a signal to delineate the horizontal active area of the display array 30 being addressed. This horizontal active area can be changed via register settings in the driver controller 29. These register settings can be changed by the processor 21. This signal is usually designated as display enable (DE). Most all display video interfaces in addition utilize a line pulse (LP) or a horizontal synchronization (HSYNC) signal, which indicates the end of a line of data. A circuit which counts LPs can determine the vertical position of the current row. When refresh signals are conditioned upon the DE from the processor 21 (signaling for a horizontal region), and upon the LP counter circuit (signaling for a vertical region) an area update function can be implemented.

In one embodiment, a driver controller 29 is integrated with the array driver 22. Such an embodiment is common in highly integrated systems such as cellular phones, watches, and other small area displays. Specialized circuitry within such an integrated array driver 22 first determines which pixels and hence rows require refresh, and only selects those rows that have pixels that have changed to update. With such circuitry, particular rows can be addressed in non-sequential order, on a changing basis depending on image content. This embodiment has the advantage that since only the changed video data needs to be sent through the interface, data rates can be reduced between the processor 21 and the display array 30. Lowering the effective data rate required between processor 21 and array driver 22 improves power consumption, noise immunity and electromagnetic interference issues for the system.

FIGS. 4 and 5 illustrate one possible actuation protocol for creating a display frame on the 3×3 array of FIG. 3. FIG. 4B illustrates a possible set of column and row voltage levels that may be used for pixels exhibiting the hysteresis curves of FIG. 4A. In the FIGS. 4A/4B embodiment, actuating a pixel may involve setting the appropriate column to $-V_{bias}$, and the appropriate row to $+\Delta V$, which may correspond to −5 volts and +5 volts respectively. Releasing the pixel may be accomplished by setting the appropriate column to $+V_{bias}$, and the appropriate row to the same $+\Delta V$, producing a zero volt potential difference across the pixel. In those rows where the row voltage is held at zero volts, the pixels are stable in whatever state they were originally in, regardless of whether the column is at $+V_{bias}$, or $-V_{bias}$. Similarly, actuating a pixel may involve setting the appropriate column to $+V_{bias}$, and the appropriate row to $-\Delta V$, which may correspond to 5 volts and −5 volts respectively. Releasing the pixel may be accomplished by setting the appropriate column to $-V_{bias}$, and the appropriate row to the same $-\Delta V$, producing a zero volt potential difference across the pixel. In those rows where the row voltage is held at zero volts, the pixels are stable in whatever state they were originally in, regardless of whether the column is at $+V_{bias}$, or $-V_{bias}$.

Figure 5A:
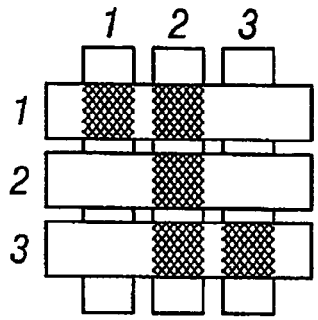
FIGS. 5A and 5B illustrate one exemplary timing diagram for row and column signals that may be used to write a frame of data to the 3×3 interferometric modulator display array of FIG. 3A.
Figure 5B:
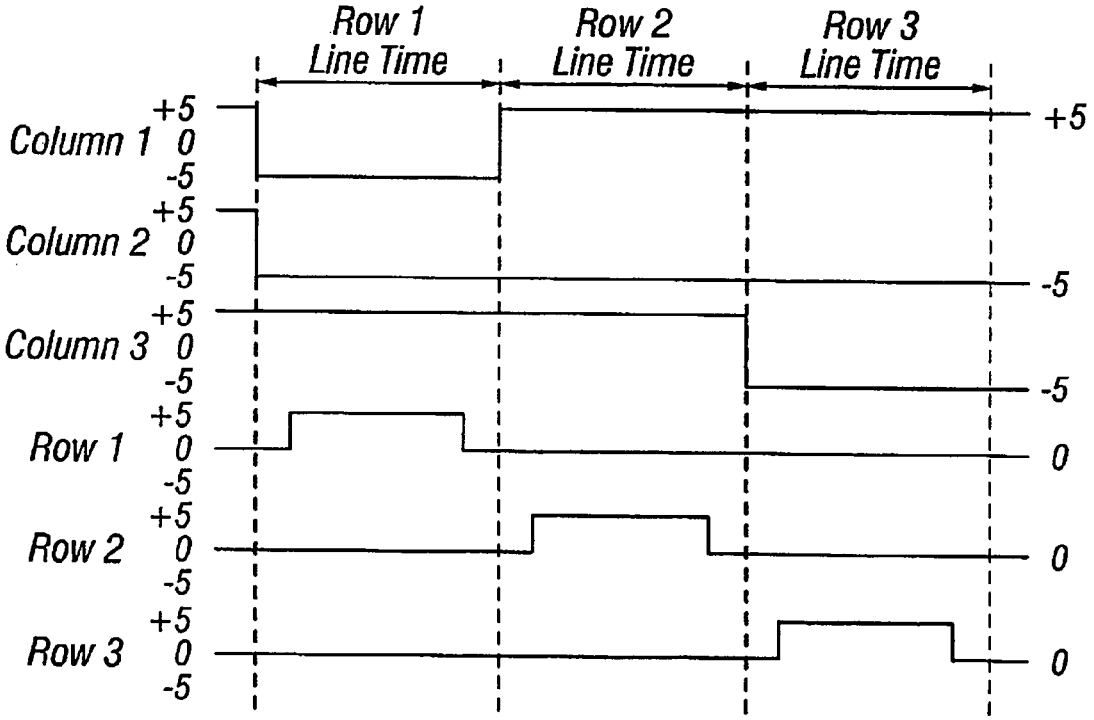

FIG. 5B is a timing diagram showing a series of row and column signals applied to the 3×3 array of FIG. 3A which will result in the display arrangement illustrated in FIG. 5A, where actuated pixels are non-reflective. Prior to writing the frame illustrated in FIG. 5A, the pixels can be in any state, and in this example, all the rows are at 0 volts, and all the columns are at +5 volts. With these applied voltages, all pixels are stable in their existing actuated or released states.

In the FIG. 5A frame, pixels (1,1), (1,2), (2,2), (3,2) and (3,3) are actuated. To accomplish this, during a "line time" for row 1, columns 1 and 2 are set to −5 volts, and column 3 is set to +5 volts. This does not change the state of any pixels, because all the pixels remain in the 3-7 volt stability window. Row 1 is then strobed with a pulse that goes from 0, up to 5 volts, and back to zero. This actuates the (1,1) and (1,2) pixels and releases the (1,3) pixel. No other pixels in the array are affected. To set row 2 as desired, column 2 is set to −5 volts, and columns 1 and 3 are set to +5 volts. The same strobe applied to row 2 will then actuate pixel (2,2) and release pixels (2,1) and (2,3). Again, no other pixels of the array are affected. Row 3 is similarly set by setting columns 2 and 3 to −5 volts, and column 1 to +5 volts. The row 3 strobe sets the row 3 pixels as shown in FIG. 5A. After writing the frame, the row potentials are zero, and the column potentials can remain at either +5 or −5 volts, and the display is then stable in the arrangement of FIG. 5A. It will be appreciated that the same procedure can be employed for arrays of dozens or hundreds of rows and columns. It will also be appreciated that the timing, sequence, and levels of voltages used to perform row and column actuation can be varied widely within the general principles outlined above, and the above example is exemplary only, and any actuation voltage method can be used.

Figure 6A:
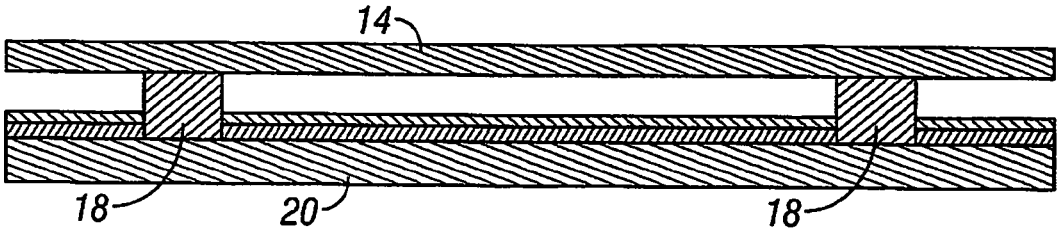
FIG. 6A is a cross section of the interferometric modulator of FIG. 2.
Figure 6B:
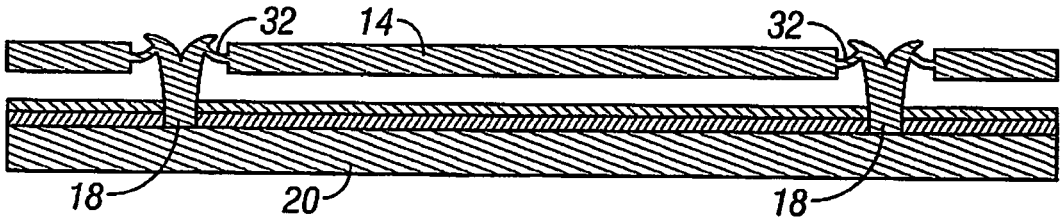
FIG. 6B is a cross section of an alternative embodiment of an interferometric modulator.
Figure 6C:
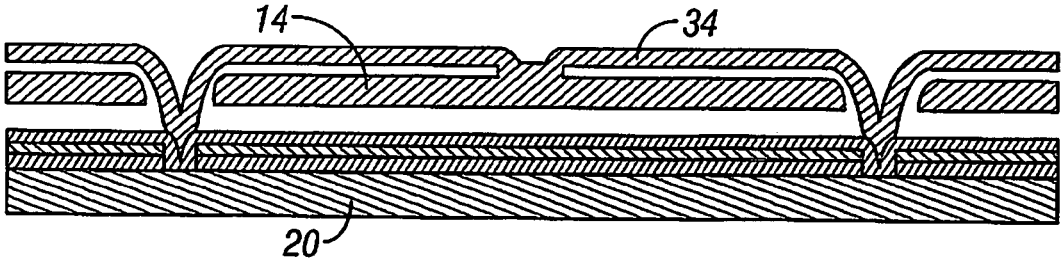
FIG. 6C is a cross section of another alternative embodiment of an interferometric modulator.

The details of the structure of interferometric modulators that operate in accordance with the principles set forth above may vary widely. For example, FIGS. 6A-6C illustrate three different embodiments of the moving mirror structure. FIG. 6A is a cross section of the embodiment of FIG. 2, where a strip of reflective material 14 is deposited on orthogonal supports 18. In FIG. 6B, the reflective material 14 is attached to supports 18 at the corners only, on tethers 32. In FIG. 6C, the reflective material 14 is suspended from a deformable layer 34. This embodiment has benefits because the structural design and materials used for the reflective material 14 can be optimized with respect to the optical properties, and the structural design and materials used for the deformable layer 34 can be optimized with respect to desired mechanical properties. The production of various types of interferometric devices is described in a variety of published documents, including, for example, U.S. Published Application 2004/0051929. A wide variety of well known techniques may be used to produce the above described structures involving a series of material deposition, patterning, and etching steps.

Figure 7:
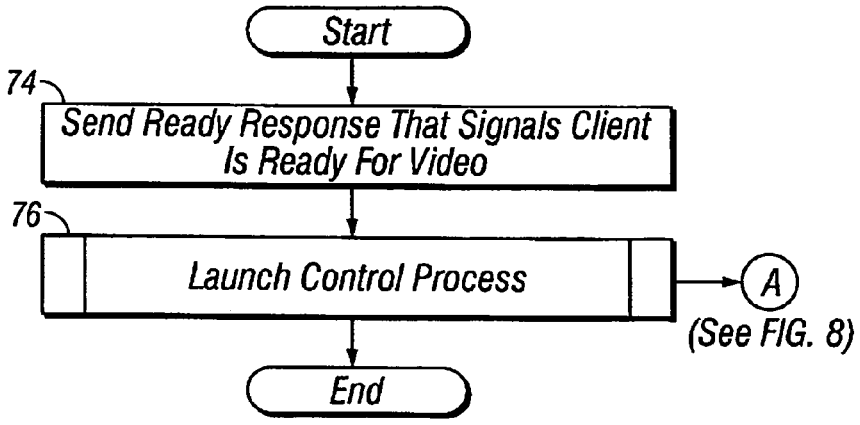
FIG. 7 is a high level flowchart of a client control process.

An embodiment of process flow is illustrated in FIG. 7, which shows a high-level flowchart of a client device 7 control process. This flowchart describes the process used by a client device 7, such as a laptop computer 4, a PDA 5, or a cell phone 6, connected to a network 3, to graphically display video data, received from a server 2 via the network 3. Depending on the embodiment, states of FIG. 7 can be removed, added, or rearranged.

Again referring to FIG. 7, starting at state 74 the client device 7 sends a signal to the server 2 via the network 3 that indicates the client device 7 is ready for video. In one embodiment a user may start the process of FIG. 7 by turning on an electronic device such as a cell phone. Continuing to state 76 the client device 7 launches its control process. An example of launching a control process is discussed further with reference to FIG. 8.

Figure 8:
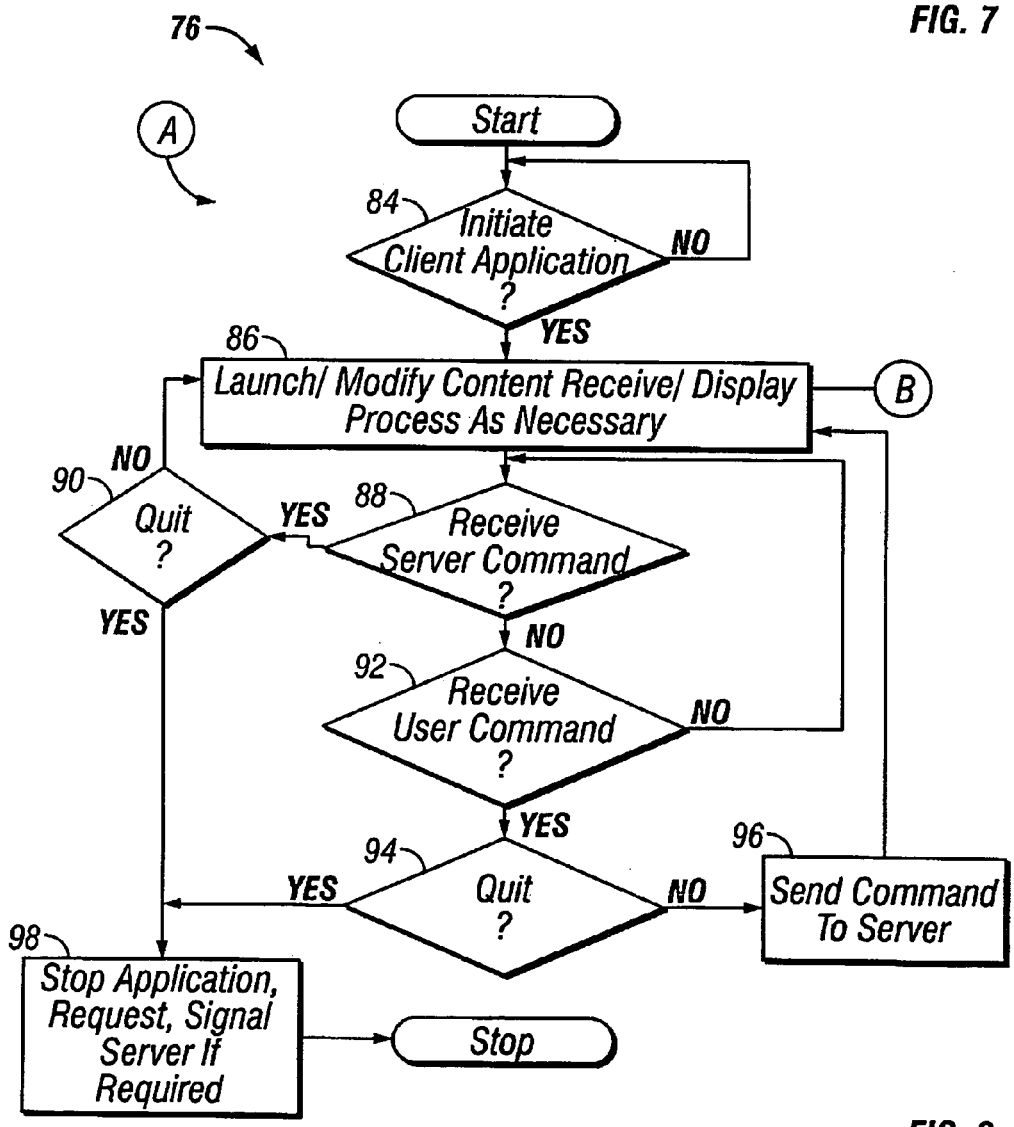
FIG. 8 is a flowchart of a client control process for launching and running a receive/display process.

An embodiment of process flow is illustrated in FIG. 8, which shows a flowchart of a client device 7 control process for launching and running a control process. This flowchart illustrates in further detail state 76 discussed with reference to FIG. 7. Depending on the embodiment, states of FIG. 8 can be removed, added, or rearranged.

Starting at decision state 84, the client device 7 makes a determination whether an action at the client device 7 requires an application at the client device 7 to be started, or whether the server 2 has transmitted an application to the client device 7 for execution, or whether the server 2 has transmitted to the client device 7 a request to execute an application resident at the client device 7. If there is no need to launch an application the client device 7 remains at decision state 84. After starting an application, continuing to state 86, the client device 7 launches a process by which the client device 7 receives and displays video data. The video data may stream from the server 2, or may be downloaded to the client device 7 memory for later access. The video data can be video, or a still image, or textual or pictorial information. The video data can also have various compression encodings, and be interlaced or progressively scanned, and have various and varying refresh rates. The display array 30 may be segmented into regions of arbitrary shape and size, each region receiving video data with characteristics, such as refresh rate or compression encoding, specific only to that region. The regions may change video data characteristics and shape and size. The regions may be opened and closed and re-opened. Along with video data, the client device 7 can also receive control data. The control data can comprise commands from the server 2 to the client device 7 regarding, for example, video data characteristics such as compression encoding, refresh rate, and interlaced or progressively scanned video data. The control data may contain control instructions for segmentation of display array 30, as well as differing instructions for different regions of display array 30.

In one exemplary embodiment, the server 2 sends control and video data to a PDA via a wireless network 3 to produce a continuously updating clock in the upper right corner of the display array 30, a picture slideshow in the upper left corner of the display array 30, a periodically updating score of a ball game along a lower region of the display array 30, and a cloud shaped bubble reminder to buy bread continuously scrolling across the entire display array 30. The video data for the photo slideshow are downloaded and reside in the PDA memory, and they are in an interlaced format. The clock and the ball game video data stream text from the server 2. The reminder is text with a graphic and is in a progressively scanned format. It is appreciated that here presented is only an exemplary embodiment. Other embodiments are possible and are encompassed by state 86 and fall within the scope of this discussion.

Continuing to decision state 88, the client device 7 looks for a command from the server 2, such as a command to relocate a region of the display array 30, a command to change the refresh rate for a region of the display array 30, or a command to quit. Upon receiving a command from the server 2, the client device 7 proceeds to decision state 90, and determines whether or not the command received while at decision state 88 is a command to quit. If, while at decision state 90, the command received while at decision state 88 is determined to be a command to quit, the client device 7 continues to state 98, and stops execution of the application and resets. The client device 7 may also communicate status or other information to the server 2, and/or may receive such similar communications from the server 2. If, while at decision state 90, the command received from the server 2 while at decision state 88 is determined to not be a command to quit, the client device 7 proceeds back to state 86. If, while at decision state 88, a command from the server 2 is not received, the client device 7 advances to decision state 92, at which the client device 7 looks for a command from the user, such as a command to stop updating a region of the display array 30, or a command to quit. If, while at decision state 92, the client device 7 receives no command from the user, the client device 7 returns to decision state 88. If, while at decision state 92, a command from the user is received, the client device 7 proceeds to decision state 94, at which the client device 7 determines whether or not the command received in decision state 92 is a command to quit. If, while at decision state 94, the command from the user received while at decision state 92 is not a command to quit, the client device 7 proceeds from decision state 94 to state 96. At state 96 the client device 7 sends to the server 2 the user command received while at state 92, such as a command to stop updating a region of the display array 30, after which it returns to decision state 88. If, while at decision state 94, the command from the user received while at decision state 92 is determined to be a command to quit, the client device 7 continues to state 98, and stops execution of the application. The client device 7 may also communicate status or other information to the server 2, and/or may receive such similar communications from the server 2.

Figure 9:
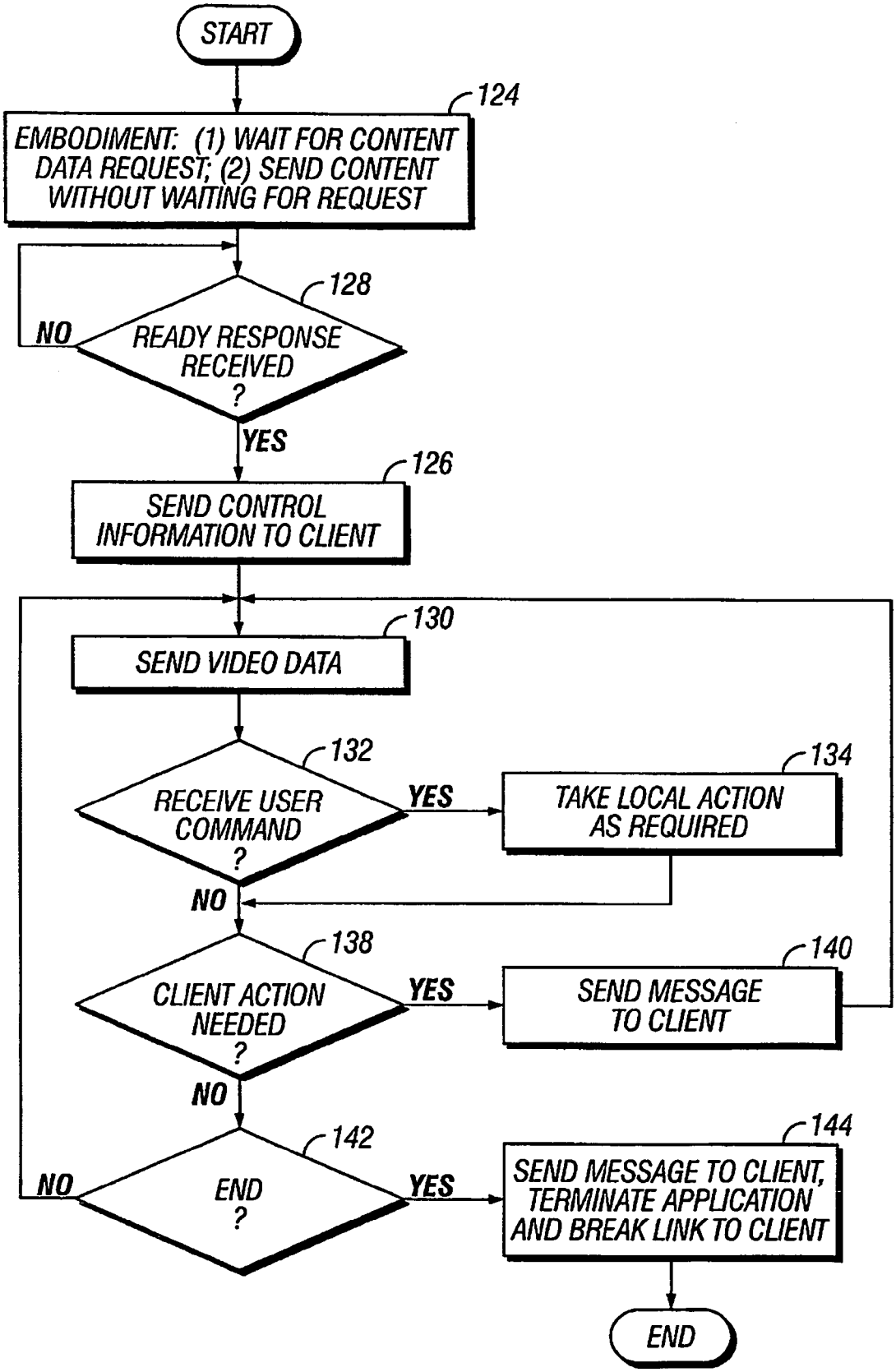
FIG. 9 is a flowchart of a server control process for sending video data to a client.

FIG. 9 illustrates a control process by which the server 2 sends video data to the client device 7. The server 2 sends control information and video data to the client device 7 for display. Depending on the embodiment, states of FIG. 9 can be removed, added, or rearranged.

Starting at state 124 the server 2, in embodiment (1), waits for a data request via the network 3 from the client device 7, and alternatively, in embodiment (2) the server 2 sends video data without waiting for a data request from the client device 7. The two embodiments encompass scenarios in which either the server 2 or the client device 7 may initiate requests for video data to be sent from the server 2 to the client device 7.

The server 2 continues to decision state 128, at which a determination is made as to whether or not a response from the client device 7 has been received indicating that the client device 7 is ready (ready indication signal). If, while at state 128, a ready indication signal is not received, the server 2 remains at decision state 128 until a ready indication signal is received.

Once a ready indication signal is received, the server 2 proceeds to state 126, at which the server 2 sends control data to the client device 7. The control data may stream from the server 2, or may be downloaded to the client device 7 memory for later access. The control data may segment the display array 30 into regions of arbitrary shape and size, and may define video data characteristics, such as refresh rate or interlaced format for a particular region or all regions. The control data may cause the regions to be opened or closed or reopened.

Continuing to state 130, the server 2 sends video data. The video data may stream from the server 2, or may be downloaded to the client device 7 memory for later access. The video data can include motion images, or still images, textual or pictorial images. The video data can also have various compression encodings, and be interlaced or progressively scanned, and have various and varying refresh rates. Each region may receive video data with characteristics, such as refresh rate or compression encoding, specific only to that region.

The server 2 proceeds to decision state 132, at which the server 2 looks for a command from the user, such as a command to stop updating a region of the display array 30, to increase the refresh rate, or a command to quit. If, while at decision state 132, the server 2 receives a command from the user, the server 2 advances to state 134. At state 134 the server 2 executes the command received from the user at state 132, and then proceeds to decision state 138. If, while at decision state 132, the server 2 receives no command from the user, the server 2 advances to decision state 138.

At state 138 the server 2 determines whether or not action by the client device 7 is needed, such as an action to receive and store video data to be displayed later, to increase the data transfer rate, or to expect the next set of video data to be in interlaced format. If, while at decision state 138, the server 2 determines that an action by the client is needed, the server 2 advances to state 140, at which the server 2 sends a command to the client device 7 to take the action, after which the server 2 then proceeds to state 130. If, while at decision state 138, the server 2 determines that an action by the client is not needed, the server 2 advances to decision state 142.

Continuing at decision state 142, the server 2 determines whether or not to end data transfer. If, while at decision state 142, the server 2 determines to not end data transfer, server 2 returns to state 130. If, while at decision state 142, the server 2 determines to end data transfer, server 2 proceeds to state 144, at which the server 2 ends data transfer, and sends a quit message to the client. The server 2 may also communicate status or other information to the client device 7, and/or may receive such similar communications from the client device 7.

Because bi-stable displays, as do most flat panel displays, consume most of their power during frame update, it is desirable to be able to control how often a bi-stable display is updated in order to conserve power. For example, if there is very little change between adjacent frames of a video stream, the display array may be refreshed less frequently with little or no loss in image quality. As an example, image quality of typical PC desktop applications, displayed on an interferometric modulator display, would not suffer from a decreased refresh rate, since the interferometric modulator display is not susceptible to the flicker that would result from decreasing the refresh rate of most other displays. Thus, during operation of certain applications, the PC display system may reduce the refresh rate of bi-stable display elements, such as interferometric modulators, with minimal effect on the output of the display.

Similarly, if a display device is being refreshed at a rate that is higher than the frame rate of the incoming video data, the display device may reduce power requirements by reducing the refresh rate. While reduction of the refresh rate is not possible on a typical display, such as an LCD, a bi-stable display, such as an interferometric modulator display, can maintain the state of the pixel element for a longer period of time and, thus, may reduce the refresh rate when necessary. As an example, if a video stream being displayed on a PDA has a frame rate of 15 Hz and the bi-stable PDA display is capable of refreshing at a rate of 60 times per second (having a refresh rate of 1/60 sec=16.67 ms), then a typical bi-stable display may update the display with each frame of video data up to four times. For example, a 15 Hz frame rate updates every 66.67 ms. For a bi-stable display having a refresh rate of 16.67 ms, each frame may be displayed on the display device up to 66.67 ms/16.67 ms=4 times. However, each refresh of the display device requires some power and, thus, power may be reduced by reducing the number of updates to the display device. With respect to the above example, when a bi-stable display device is used, up to 3 refreshes per video frame may be removed without affecting the output display. More particularly, because both the on and off states of pixels in a bi-stable display may be maintained without refreshing the pixels, a frame of video data from the video stream need only be updated on the display device once, and then maintained until a new video frame is ready for display. Accordingly, a bi-stable display may reduce power requirements by refreshing each video frame only once.

In one embodiment, frames of a video stream are skipped, based on a programmable "frame skip count." Referring to FIG. 3A, in one embodiment of a bi-stable display, a display driver, such as array driver 22, is programmed to skip a number of refreshes that are available to the bi-stable display, the interferometric modulator display array 30. In one embodiment, a register in the array driver 22 stores a value, such as 0, 1, 2, 3, 4, etc, that represents a frame skip count. The driver may then access this register in order to determine the frequency of refreshing the display array 30. For example, the values 0, 1, 2, 3, 4, and 5 may indicate that the driver updates the display array 30 every frame, every other frame, every third frame, every fourth frame, every fifth frame, and every sixth frame respectively. In one embodiment, this register is programmable through a communication bus (of either parallel or serial type) or a direct serial link, such as via a SPI. In another embodiment, the register is programmable from a direct connection with a controller, such as the driver controller 29. Also, to eliminate the need for any serial or parallel communication channel beyond the high-speed data transmission link described above, the register programming information can be embedded within the data transmission stream at the controller and extracted from that stream at the driver.

Figure 10:
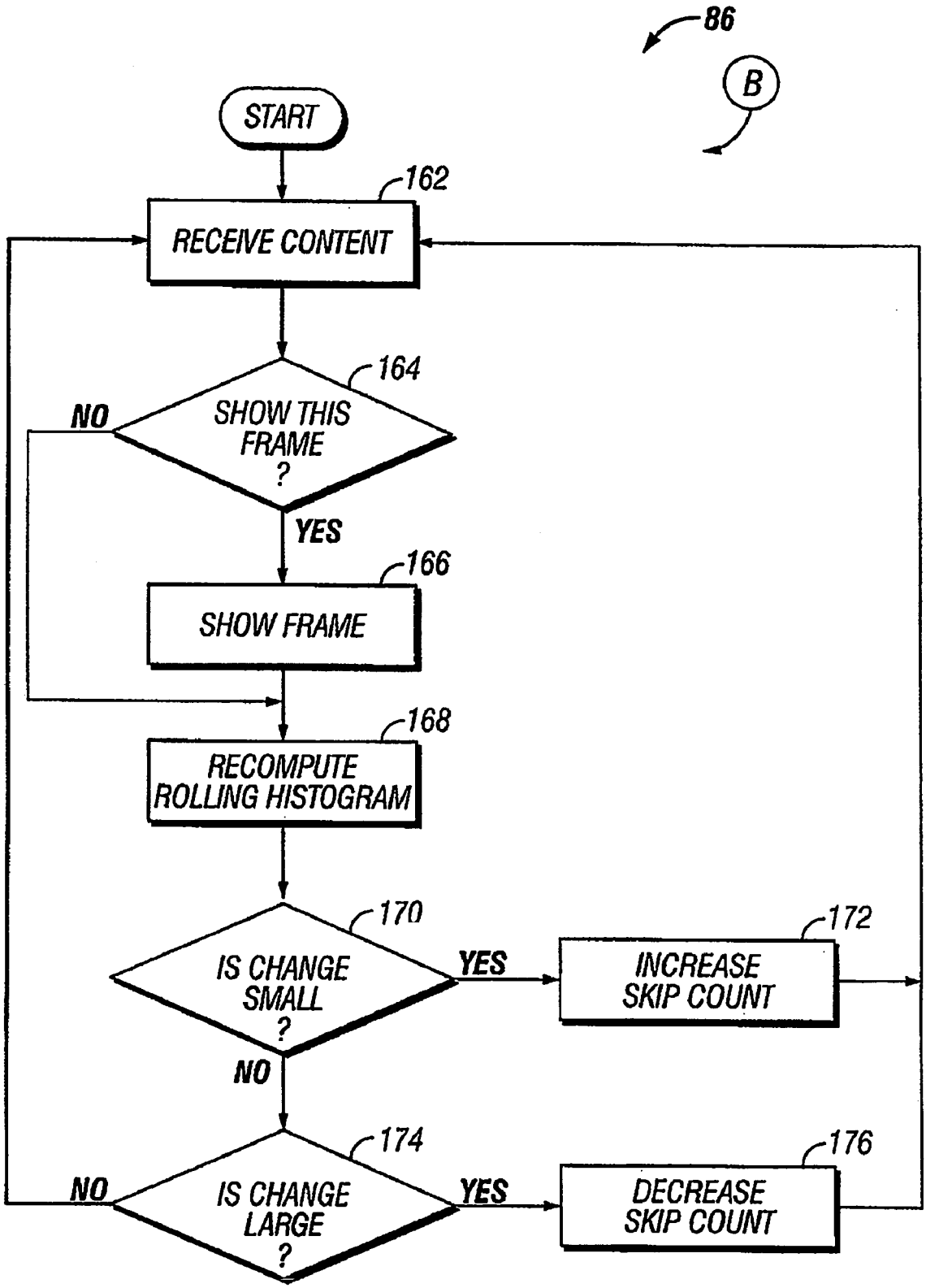
FIG. 10 is a flowchart of a frame skip count control process.

FIG. 10 is a flowchart of a frame skip count control process of a client device 7, illustrating a process 86 for determining the frame skip count of a sequence of video data frames. This process 86 can be entered as the "launch/modify content receive/display as necessary" process state 86 show in FIG. 8. Depending on the embodiment, states of FIG. 10 can be removed, added, or rearranged.

Starting at state 162, a client device 7 receives video data from a server 2, where the video data can include one or more frames of video data. The server 2 and the client device 7 can be a variety of devices, for example, a server 2 and the client device 7 as shown in FIG. 1 and discussed hereinabove, or another type of server 2 and client device 7.

At state 164, the process processes a frame of video data and determines whether or not to show the frame. The determination of whether or not to show the frame can use a pre-programmed frame skip count, a user specified frame skip count, or a frame skip count that can be dynamically determined during processing. If the frame skip count is such that the frame should be shown, in state 166 the process displays the frame and then continues to the next state 168. If the frame skip count is such that the frame should be skipped, the process 86 does not show the frame, and the process 86 continues to state 168.

In state 168, a rolling histogram is computed using the content from one or more of the previously received frames. The histogram may be computed, for example, at the server 2 or at the client device 7, in the processor 21, or in the driver controller 29. The processor 21 can be configured to communicate histogram computations via the data link 31 or through data embedded in the high speed data stream.

After the histogram is calculated, the process 86 continues to state 170 where a determination is made regarding an adjustment to the frame skip count to be increased. The currently processed frame is compared to the resulting rolling histogram and analyzed to determine if the frame depicts change indicating that the frame skip count should be adjusted. The frame skip count can be determined, for example, at the server 2 or at the client device 7, in the processor 21, or in the driver controller 29. If the change in the video content is small, the process 86 continues to state 172, and the frame skip count is increased so that frames are displayed less frequently. The processor 21 can be configured to change the frame skip count and communicate the new frame skip count via the data link 31 or through data embedded in the high speed data stream. In one embodiment, the processor 21 or the driver controller 29 may adjust the frame skip count based partly on a user selected video quality and the then-current video characteristics. In one embodiment, the change between the current frame and the rolling histogram can be computed and compared to a predetermined threshold value to determine if the frame skip count should be changed. After the adjustment in state 172, the process 86 continues back to state 162 where it receives more content. If the change is not slow, the process 86 continues to state 174 where a determination is made regarding an adjustment to the frame skip count to be decreased. Processes and methods used in state 170 may analogously be used in state 174 to determine if the frame skip count is too high. If the frame skip count is determined to be too high, the process 86 continues to state 176 where the frame skip count is decreased so that frames are displayed more frequently. Processes and methods used in state 172 may analogously be used in state 176 to adjust the frame skip count. The process 86 continues to state 162 to receive more video content. If the change does not meet the threshold indicating the change in content is too large, the process 86 does not change the frame skip count and continues to state 162 to receive more video content.

While the above detailed description has shown, described, and pointed out novel features as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others.

The invention claimed is:

1. A display, comprising:

at least one driving circuit; and an array comprising a plurality of bi-stable display elements, the array being configured to be driven by the driving circuit, wherein the driving circuit is configured to receive video data and provide at least a subset of the received video data to the array based on a frame skip count, the frame skip count indicating a number of refresh periods to skip before refreshing any portion of the entire array, and wherein determination of the frame skip count comprises selecting the frame skip count based on a calculated histogram of the video data.

2. The display of claim 1, wherein the frame skip count is programmable.

3. The display of claim 2, wherein the frame skip count is dynamically determined.

4. The display of claim 1, wherein the driving circuit is further configured to provide a subset of the video data to the array based on changes that occur in one or more portions of the video data during a time period.

5. The display of claim 4, wherein the driving circuit is further configured to evaluate the changes in the video data on a pixel-by-pixel basis.

6. The display of claim 1, wherein the driving circuit is further configured to provide the video data based on a display mode.

7. The display of claim 1, further comprising a user input device, wherein determination of the frame skip count further comprises a selection using the user input device.

8. The display of claim 1, wherein the frame skip count comprises a single value.

9. A method of displaying data on an array having a plurality of bi-stable display elements, the method comprising:

receiving video data comprising a plurality of frames;

displaying the received frames using a frame skip count, wherein the frame skip count indicates a number of refresh periods to skip before refreshing any portion of the entire array;

calculating a histogram using a selected frame of the plurality of frames and one or more frames received previous to the selected frame; and changing the frame skip count based on the histogram.

10. The method of claim 9, further comprising:

determining a measure of the change in video content between a selected frame of the plurality of frames and one or more frames received previous to the selected frame using the histogram.

11. The method of claim 10, wherein changing the frame skip count comprises increasing the frame skip count if the change in video content between the selected frame and one or more previous frames is small, and decreasing the frame skip count if the change in video content between the selected frame and the one or more previous frames is large.

12. The method of claim 9, wherein the frame skip count comprises a single value.

13. A system for displaying data on an array having a plurality of bi-stable display elements, the system comprising:

means for receiving video data comprising a plurality of frames;

means for displaying frames using a frame skip count, wherein the frame skip count indicates a number of refresh periods to skip before refreshing any portion of the entire array;

means for calculating a histogram using a selected frame of the plurality of frames and one or more frames received previous to the selected frame; and means for changing the frame skip count based on the histogram.

14. The system of claim 13, further comprising:

means for determining a measure of the change in video content between a selected frame of the plurality of frames and one or more frames received previous to the selected frame using the histogram.

15. The system of claim 14, wherein the means for changing the frame skip count comprises means for increasing the frame skip count if the change in video content between the selected frame and one or more previous frames is small, and means for decreasing the frame skip count if the change in video content between the selected frame and the one or more previous frames is large.

16. The system of claim 13 further comprising a user input means for receiving input from a user, wherein determination of the frame skip count comprises a selection using the user input means.

17. The system of claim 13, wherein the frame skip count comprises a single value.

* * * * *